US006377772B1

(12) United States Patent
Chowdry et al.

(10) Patent No.: US 6,377,772 B1
(45) Date of Patent: Apr. 23, 2002

(54) DOUBLE-SLEEVED ELECTROSTATOGRAPHIC ROLLER AND METHOD OF USING

(75) Inventors: Arun Chowdry, Rochester; Craig M. Cody, Scottsville; Steven Cormier, Rochester; Dennis Grabb, Rochester; Diane M. Herrick, Rochester; John W. May, Rochester; Edward T. Miskinis, Rochester; Michel F. Molaire, Rochester; Biao Tan, Rochester; Thomas Tombs, Brockport; Joseph A. Pavlisko, Pittsford, all of NY (US)

(73) Assignee: NexPress Solutions LLC, Rochester, NY (US)

( * ) Notice: Subject to any disclaimer, the term of this patent is extended or adjusted under 35 U.S.C. 154(b) by 0 days.

(21) Appl. No.: 09/679,016

(22) Filed: Oct. 4, 2000

(51) Int. Cl.[7] ..... G03G 15/01
(52) U.S. Cl. ..... 399/302; 399/159; 492/48
(58) Field of Search ..... 399/276, 279, 399/286, 302, 159, 161, 308; 492/48, 49, 53, 56; 101/375, 376

(56) References Cited

U.S. PATENT DOCUMENTS 3,982,312 A * 9/1976 Finzer ..... 492/56
5,298,956 A 3/1994 Mammino et al. ..... 399/308
5,819,657 A * 10/1998 Rossini ..... 101/376

* cited by examiner

*Primary Examiner*—Arthur T. Grimley
*Assistant Examiner*—Hoan Tran

(57) ABSTRACT

In accordance with the invention, there is provided a reproduction method including forming a toner image on a moving primary image-forming member (PIFM) which is a first double-sleeved roller including a rigid cylindrical core member, a replaceable removable compliant inner sleeve member (ISM) in nonadhesive intimate contact with and surrounding the core member, and a replaceable removable photoconductive outer sleeve member (OSM) in nonadhesive intimate contact with and surrounding the ISM; electrostatically transferring the toner image, from the PIFM to a counter-rotating intermediate transfer member (ITM) which is a second double-sleeved roller, in a first transfer nip width produced by a pressure contact between the PIFM and the ITM, an electric field urging the toner image from the PIFM to the ITM, wherein the ITM includes a rigid cylindrical core member, a compliant ISM in nonadhesive intimate contact with and surrounding the core member, and a compliant resistive OSM in nonadhesive intimate contact with and surrounding the ISM.

21 Claims, 12 Drawing Sheets

DOUBLE-SLEEVED ELECTROSTATOGRAPHIC ROLLER AND METHOD OF USING

CROSS REFERENCE TO RELATED APPLICATIONS

Reference is made to the commonly assigned U.S. Patent Applications, the disclosures of which are incorporated herein by reference.

U.S. patent application Ser. No. 09/679,113, filed Oct. 4, 2000, in the names of Robert Charlebois et al., entitled INTERMEDIATE TRANSFER MEMBER HAVING A STIFFENING LAYER AND METHOD OF USING.

U.S. patent application Ser. No. 09/679,177, filed Oct. 4, 2000, in the names of Muhammed Aslam et al., entitled SLEEVED ROLLERS FOR USE IN A FUSING STATION EMPLOYING AN INTERNALLY HEATED FUSER ROLLER.

U.S. patent application Ser. No. 09/679,345, filed Oct. 4, 2000, in the names of Jiann-Hsing Chen et al., entitled EXTERNALLY HEATED DEFORMABLE FUSER ROLLER.

U.S. patent application Ser. No. 09/680,133, filed Oct. 4, 2000, in the names of Arun Chowdry et al., entitled SLEEVED PHOTOCONDUCTIVE MEMBER AND METHOD OF MAKING.

U.S. patent application Ser. No. 09/680,134, filed Oct. 4, 2000, in the names of Muhammed Aslam et al., entitled SLEEVED ROLLERS FOR USE IN A FUSING STATION EMPLOYING AN EXTERNALLY HEATED FUSER ROLLER.

U.S. patent application Ser. No. 09/680,135, filed Oct. 4, 2000, in the names of Jiann-Hsing Chen et al., entitled TONER FUSING STATION HAVING AN INTERNALLY HEATED FUSER ROLLER.

U.S. patent application Ser. No. 09/680,139, filed Oct. 4, 2000, in the names of Robert Charlebois et al., entitled INTERMEDIATE TRANSFER MEMBER WITH A REPLACEABLE SLEEVE AND METHOD OF USING SAME.

U.S. patent application Ser. No. 09/680,136, filed Oct. 4, 2000, in the names of Arun Chowdry et al., entitled IMPROVED INTERMEDIATE TRANSFER MEMBER.

U.S. patent application Ser. No. 09/680,138 filed Oct. 4, 2000, in the names of Jiann-Hsing Chen et al., entitled TONER FUSING STATION HAVING AN EXTERNALLY HEATED FUSER ROLLER.

FIELD OF THE INVENTION

This invention relates to apparatus and methods of electrostatography using a double-sleeved roller, and more particularly, to electrostatographic apparatus and methods of using a double-sleeved compliant roller, either as a primary image-forming member or as an intermediate transfer member for electrostatic transfer of toner images to receiver members.

BACKGROUND OF THE INVENTION

The use of an intermediate transfer member in an electrostatographic machine to transfer toner from an imaging member to a receiver (e.g., paper) is well known and is practiced in commercial electrophotographic copiers and printers. A toner image formed on a primary image-forming member (PIFM) is transferred in a first transfer operation to an intermediate transfer member (ITM), and is subsequently transferred in a second transfer operation from the ITM to a receiver. In the second transfer of a toner image from an ITM roller to a receiver, a transfer back-up roller is commonly used behind a paper receiver, a nip being formed to press the receiver to the ITM.

As disclosed by Rimai et al., in U.S. Pat. No. 5,084,735 and Zaretsky and Gomes, in U.S. Pat. No. 5,370,961, use of a compliant ITM roller coated by a thick compliant layer and a relatively thin hard overcoat improves the quality of electrostatic toner transfer from an imaging member to a receiver, as compared to a non-compliant intermediate roller. Zaretsky, in U.S. Pat. No. 5,187,526, further discloses that electrostatic transfer can be improved by separately specifying the resistivity of the ITM roller and the transfer back-up roller. Bucks et al., in U.S. Pat. No. 5,701,567 disclose an ITM roller having electrodes embedded in a compliant blanket to spatially control the applied transfer electric field. Tombs and Benwood in published international Patent Application WO 98/04961 disclose the use of a compliant ITM roller in conjunction with a paper transport belt in a multi-color electrophotographic machine.

The use of a removable endless belt or tubular type of blanket on an intermediate roller has long been practiced in the offset lithographic printing industry, as recently disclosed by Gelinas in U.S. Pat. No. 5,894,796 wherein the tubular blanket may be made of materials including rubbers and plastics and may be reinforced by an inner layer of aluminum or other metal. As disclosed earlier, for example, by Julian in U.S. Pat. No. 4,144,812, an intermediate lithographic roller includes a portion having a slightly smaller diameter than the main body of the roller, such that a blanket member may be slid along this narrower portion until it reaches a location where a set of holes located in the roller allow a fluid under pressure, e.g., compressed air, to pass through the holes, thereby stretching the blanket member and allowing the entire blanket member to be slid onto the main body of the roller. After the blanket is located in a suitable position, the source of compressed air or fluid under pressure is turned off, thereby allowing the blanket member to relax to a condition of smaller strain, such strain being sufficient to cause the blanket member to snugly embrace the roller.

An intermediate transfer roller consisting of a rigid core and a removable, replaceable intermediate transfer blanket has been disclosed by Landa et al., in U.S. Pat. No. 5,335,054, and by Gazit et al., in U.S. Pat. No. 5,745,829, whereby the intermediate transfer blanket is fixedly and replaceably secured and attached to the core. The intermediate transfer blanket, disclosed for use in conjunction with a liquid developer for toning a primary image, consists of a substantially rectangular sheet mechanically held to the core by grippers. The core (or drum) has recesses where the grippers are located. It will be evident from U.S. Pat. No. 5,335,054 and U.S. Pat. No. 5,745,829 that owing to the presence of the recesses, the entire surface of the intermediate transfer drum cannot be utilized for transfer, which is a disadvantage requiring costly means to maintain a proper orientation of the useful part of the drum when transferring a toner image from a primary imaging member to the intermediate transfer roller, or, when transferring a toner image from the intermediate transfer roller to a receiver. Moreover, the fact that the blanket does not form a continuous covering of the entire core surface, owing to the fact that two of its edges are held by grippers, is similarly a disadvantage. Another disadvantage arises because there is inevitably a gap between these edges, so that contamination can become deposited there which may lead to transfer artifacts.

An electrostatographic imaging member in the form of a removable replaceable endless imaging belt on a rigid roller is disclosed by Yu et al., in U.S. Pat. No. 5,415,961. The electrostatographic imaging member is placed on the rigid roller and removed from the rigid roller by means involving stretching the endless imaging belt with a pressurized fluid.

Mammino et al., in U.S. Pat. No. 5,298,956 and U.S. Pat. No. 5,409,557, disclose a reinforced seamless intermediate transfer member that may be in the shape of a belt, sleeve, tube or roll and including a reinforcing member in an endless configuration having filler material and electrical property regulating material on, around or embedded in the reinforcing member. The reinforcing member may be made of metal, synthetic material or fibrous material, and has a tensile modulus ranging from about 400,000 to more than 1,000,000 psi (2.8 to more than 6.9 GPa). The intermediate transfer member has a thickness between 2 mils and about 7 mils, and a bulk resistivity less than about $10^{12}$ ohm-cm.

May and Tombs in U.S. Pat. No. 5,715,505 and U.S. Pat. No. 5,828,931 disclose a PIFM roller including a thick compliant blanket layer coated on a core member, the thick compliant blanket surrounded by a relatively thin concentric layer of a photoconductive material. The compliant primary imaging roller provides improved electrostatic transfer of a toner image directly to a receiver member. It is disclosed that the compliant imaging roller can be used bifunctionally, i.e., it may serve also as an intermediate member for electrostatic transfer of a toner image to a receiver. May and Tombs in U.S. Pat. No. 5,732,311 disclose a compliant electrographic PIFM roller. Disclosures in U.S. Pat. No. 5,715,505, U.S. Pat. No. 5,828,931 and U.S. Pat. No. 5,732,311 are hereby incorporated by reference.

U.S. patent application Ser. No. 09/574,775 filed on even date herewith in the names of M. F. Molaire et al. discloses a single-sleeved compliant PIFM roller and a method of making such roller. The sleeve is a photoconductive member, the sleeve resting on a compliant layer coated on a core member. This improves over U.S. Pat. No. 5,715,505 and U.S. Pat. No. 5,828,931, in that the coatings including the roller are made more reliably and more cheaply and also that the photoconductive sleeve may be readily removed and replaced when at the end of its useful life, thereby lowering cost and reducing downtime. It also provides an improvement over U.S. Pat. No. 5,415,961 by providing a core member having a thick compliant layer over which the sleeve member is placeable and removable.

A central member of a sleeved ITM including a thick compliant layer coated on a rigid core member, as disclosed in Molaire et al., is disadvantageously subject to damage of the compliant layer when removing or replacing a sleeve member. In some embodiments, the rigid core member is electrically biased to effect transfer of toner, and because the electrical properties of the compliant layer coated on the core member alter with age, typically becoming more resistive, the compliant layer has a finite lifetime requiring periodic replacement of the central member. A compliant layer on a rigid core of a sleeved PIFM, as disclosed in Molaire et al., may also be subject to damage when removing or replacing a photoconductive sleeve member.

An electrostatographic imaging member that includes a photoconductive drum that has inserted therein a compressible sleeve with the composite then being expanded to fit upon a rigid cylindrical core support is disclosed by Swain in U.S. Pat. No. 5,669,045. The preferred sleeve is a foam that provides substantially no interference fit with the photoconductive drum to facilitate insertion of the sleeve within the drum. However, a relatively large interference fit exists between the rigid core and the sleeve to compress the sleeve as it is expanded by an expandable core. The compression of the sleeve is sufficient to render the electrostatographic imaging member substantially rigid and substantially free from distortion. A problem with an imaging member of the type described by Swain is that the photoconductive drum is not separately removable from the sleeve without also removing the sleeve from the core, thereby subjecting the sleeve to possible damage.

There is a need, therefore, to provide improvements for sleeved electrostatographic rollers. In particular, for sleeved ITM and sleeved PIFM rollers there is a need to lower costs by reducing potential damage to roller members over which sleeve members must be moved during removal or replacement of sleeves. Moreover, when a central member includes a core member adhesively coated by a compliant layer (over which a sleeve member may be moved) the central member must be replaced when the compliant layer is no longer useful due to aging or inadvertent damage. Typically, the core member is an expensive, highly toleranced drum, and although the central member may be regenerated by removal of the compliant layer followed by a recoating operation, this tends to be difficult and costly, and thus there is need for improvement, especially to provide cost reduction.

SUMMARY OF THE INVENTION

The invention is directed to providing improved intermediate transfer members and improved primary image-forming members that may be employed in electrostatographic apparatus and method. An improved intermediate transfer member includes a double-sleeved roller further including a cylindrical rigid core member, a compliant inner sleeve member (ISM) in intimate nonadhesive contact with and surrounding the core member, and a compliant outer sleeve member (OSM) in intimate nonadhesive contact with and surrounding the inner sleeve member. An improved primary image-forming member is a double-sleeved roller including a cylindrical rigid core member, an inner compliant sleeve member in intimate nonadhesive contact with and surrounding the core member, and a photoconductive or electrographic outer compliant sleeve member in intimate nonadhesive contact with and surrounding the inner sleeve member. An inventive double-sleeved primary image-forming member may be used bifunctionally as an intermediate transfer member. Any single inner or outer sleeve member can easily and independently be replaced on account of wear or damage, or replaced when at the end of a predetermined operational life. An expensive, finely toleranced core member can thereby be retained for long operational usage with many generations of sleeve members. The invention allows removal or placement of an inner or outer sleeve member on a core member, such that the core member remains fixed to the electrostatographic apparatus in which it is mounted.

In accordance with the invention, there is provided a reproduction method including forming a toner image on a moving primary image-forming member (PIFM) which is a first double-sleeved roller including a rigid cylindrical core member, a replaceable removable compliant inner sleeve member (ISM) in nonadhesive intimate contact with and surrounding the core member, and a replaceable removable photoconductive outer sleeve member (OSM) in nonadhesive intimate contact with and surrounding the ISM; electrostatically transferring the toner image, from the PIFM to a counter-rotating intermediate transfer member (ITM) which is a second double-sleeved roller, in a first transfer nip width produced by a pressure contact between the PIFM and the ITM, an electric field urging the toner image from the PIFM to the ITM, wherein the ITM includes a rigid cylindrical core member, a compliant ISM in nonadhesive intimate contact with and surrounding the core member, and a compliant resistive OSM in nonadhesive intimate contact with and surrounding the ISM; providing a second transfer nip width in a transfer nip produced by a pressure applied between the ITM and a transfer roller; establishing an electric field between the ITM and the transfer roller; and advancing a receiver member into said second transfer nip to electrostatically transfer said toner image from the ITM to the receiver member.

BRIEF DESCRIPTION OF THE DRAWINGS

In the detailed description of the preferred embodiments of the invention presented below, reference is made to the accompanying drawings, in some of which the relative relationships of the various components are illustrated, it being understood that orientation of the apparatus may be modified. For clarity of understanding of the drawings, relative proportions depicted or indicated of the various elements of which disclosed members are comprised may not be representative of the actual proportions, and some of the dimensions may be selectively exaggerated.

FIG. 4(*b*) illustrates a cross-sectional view of a preferred embodiment of an outer sleeve of a primary image-forming member of the invention including a compliant layer located underneath a photoconductive composite layer structure.

DETAILED DESCRIPTION OF THE PREFERRED EMBODIMENTS

Figure 1:
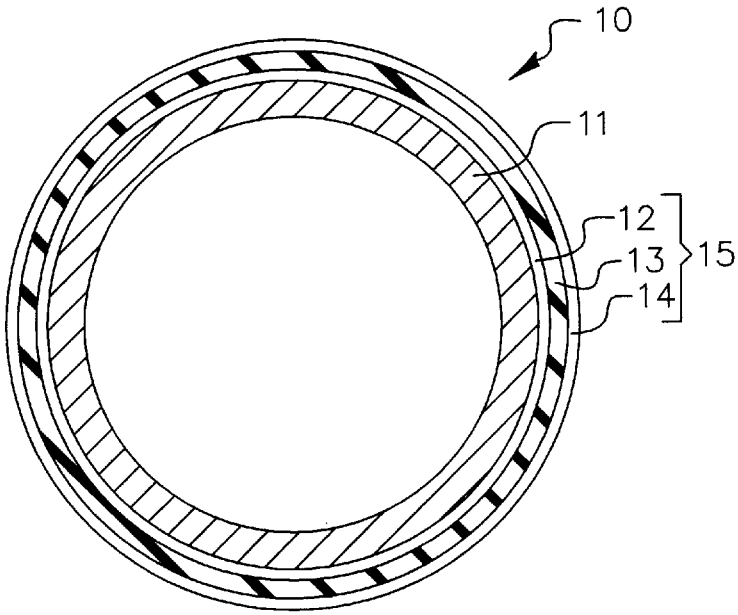
FIG. 1 illustrates a cross-sectional view of a preferred embodiment of an inner sleeve of the invention mounted on a core member.

Because apparatus of the type described herein are well known, the present description will be directed in particular to subject matter forming part of, or cooperating more directly with, the present invention.

The invention relates broadly to electrostatographic imaging, including electrographic recording using a stylus or other electrographic writer, and to electrophotographic recording using modulated light either through optical recording apparatus or electo-optical recording using LEDs, lasers and other known light modulating devices using for example modulatable mirrors or displays. As a preferred embodiment, the invention is particularly suited to electrophotographic full color imaging utilizing one or more transferable single-color toner images, whereby each single-color toner image can be formed on a compliant primary image-forming member (PIFM) including a double-sleeved roller (DSR), transferred in a first transfer step to a transfer element in the form of a compliant intermediate transfer member (ITM) including a DSR, and subsequently transferred in a second transfer step to a transfer element in the form of a receiver member, e.g., paper or a plastic sheet. Additionally, a double-sleeved ITM can serve bifunctionally as both a transfer element and as an image-forming member, i.e., it can be made photoconductive, so that a transferable first single-color toner image formed on a PIFM can be transferred in registry on top of a second single-color toner image independently formed on the photoconductive ITM, thereby creating a transferable composite two-color image on the ITM which can be subsequently transferred to a transfer element in the form of a receiver member. A double-sleeved compliant PIFM may also be used for transfer of each single-color transferable toner image directly from the PIFM to the transfer element or receiver member. As an alternative to electrophotographic recording, there may be used electrographic recording of each primary color image using stylus recorders or other known recording methods for recording a toner image on a PIFM which may comprise a dielectric sleeve member, the transferable toner image to be transferred electrostatically as described herein. Broadly, the primary image is formed using electrostatography. A PIFM may comprise a belt when a double-sleeved ITM in the form of a drum is used. An ITM may be in the form of a belt or a drum when a double-sleeved PIFM is used.

Use of a single-sleeved or double-sleeved compliant PIFM in conjunction with a single-sleeved or double-sleeved compliant ITM has several advantages in that larger nip widths can be attained for a given pressure than if the PIFM were non-compliant. This in turn allows a lower transfer voltage to be used for transfer of a toner image to an ITM. Moreover, because the nip pressure is shared between compliant PIFM and compliant ITM, the resulting hoop strains in each member (which increase with increased engagement) can be much reduced, thereby much decreasing the associated risks of delamination of a sleeve or premature aging or wear due to flexure in the compliant layers.

In prior art disclosed in Tombs and Benwood, U.S. Pat. No. 6,075,965, single-color toner images are sequentially transferred in registry to a receiver sheet carried on a moving transport web through a series of corresponding single-color modules. In each module the moving transport web frictionally drives an ITM roller which in turn frictionally drives a counter-rotating PIFM roller.

Alternatively, each module can provide transfer of a single-color toner image directly from a PIFM roller to a receiver sheet on the transport web. As disclosed for intermediate transfer embodiments by T. N. Tombs et al. in U.S. application Ser. No. 09/680,139 filed on even date herewith, a single-sleeved compliant ITM roller may be used including a central member plus a replaceable removable sleeve member, which also improves over U.S. Pat. No. 5,335,054 and U.S. Pat. No. 5,745,829 in that the sleeve member is in the form of an endless belt. The costly central member remains attached to a frame portion of the machine when the sleeve member is removed and replaced. The present invention improves over Tombs et al. by increasing the flexibility of use of an ITM, as well as by reducing the complexity of a single sleeve by providing a double-sleeved roller, wherein the macrocompliance and microcompliance functionalities are separately and respectively provided for by an inner and an outer sleeve.

Generally speaking, the compliance of a layer may be considered in terms of macrocompliance and microcompliance. In macrocompliance, the layer is able to conform to form a nip. Microcompliance, on the other hand, comes into play at, for example, the scale of individual toner particles, paper roughness, and edges of large toned solid areas. A double-sleeved roller of the invention has an extra advantage in that a stiffening layer can be included as an exterior outer surface of an inner sleeve or more preferably as an exterior inner surface of an outer sleeve, thereby avoiding certain coating complications.

Additionally, overall operating costs are reduced, inasmuch as either sleeve may be replaced without replacing the other, or else the inner and outer sleeves may be replaced with differing frequencies.

It is well established that for high quality electrostatographic color imaging, small toner particles are necessary. In the color embodiments described herein, it is preferred to use dry, insulative toner particles having a mean volume weighted diameter of between about 2 ricrometers and about 9 micrometers. The mean volume weighted diameter measured by conventional diameter measuring devices such as Coulter Multisizer, sold by Coulter, Inc. Mean volume weighted diameter is the sum of the mass of each particle times the diameter of a spherical particle of equal mass and density, divided by total particle mass. More preferably, a toner particle diameter of between 6 and 8 micrometers is employed in the present invention. A widely practiced method of improving toner transfer is to use toner particles including sub-micron particles of silica, alumina, titania, and the like, attached or adhered to the surfaces of toner particles (so-called surface additives). In practice of the present invention, it is preferred to use a surface additive including sub-micrometer sized hydrophobic fumed silica particles, but other formulations utilizing sub-micrometer particle surface additives may also be useful.

Figure 10:
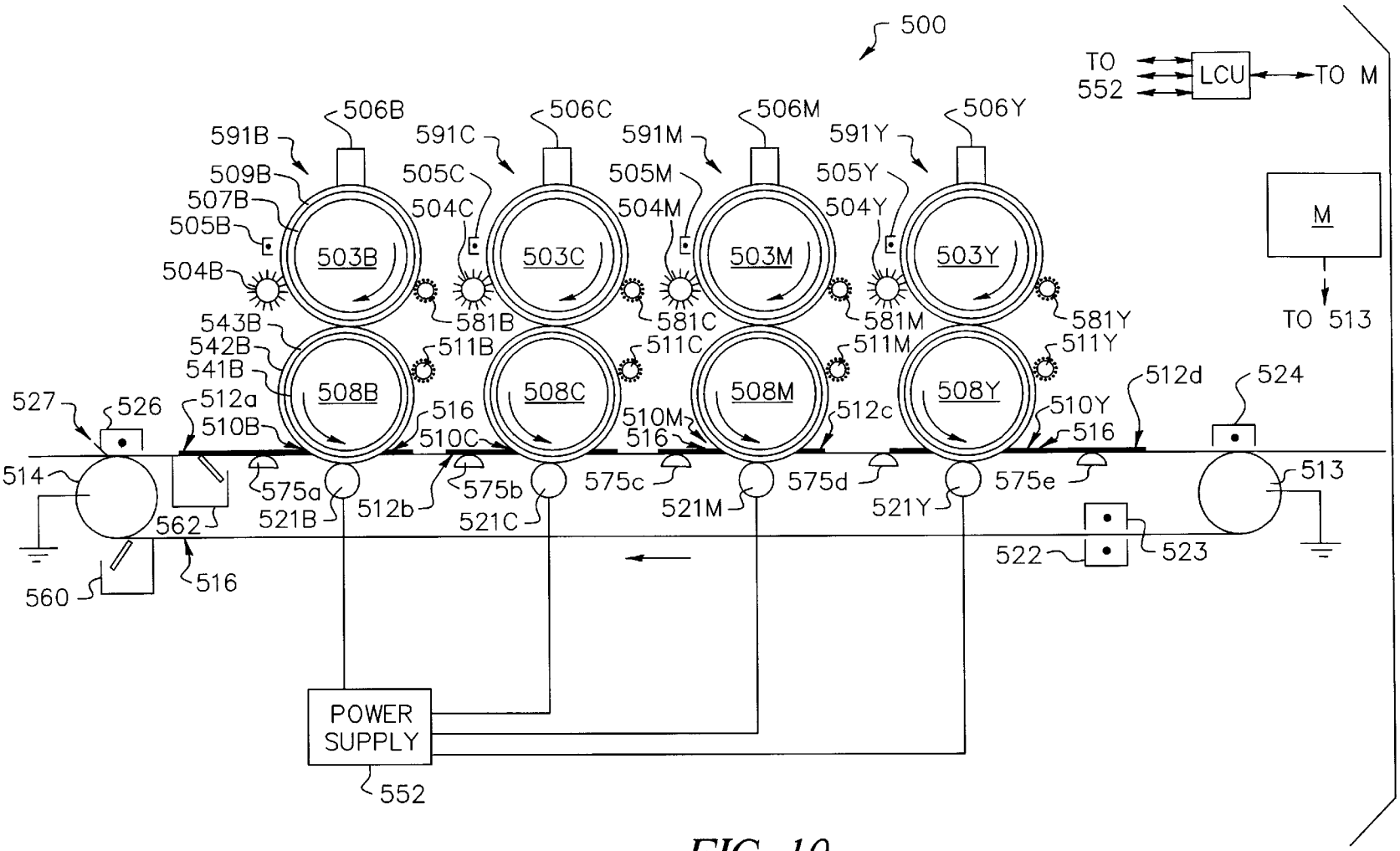
FIG. 10 is a generally schematic side elevational view of an imaging apparatus utilizing four modules, each module including a double-sleeved photoconductive primary image-forming member from which a single-color toner image is electrostatically transferred to a compliant double-sleeved ITM roller including a stiffening layer, with an endless web and web-driving mechanism for facilitating electrostatic transfer of the single-color toner image from the ITM roller to a receiver member adhered to and carried by the endless web through each of the four modules, only basic components being shown for clarity of illustration.

Referring now to the accompanying drawings, FIG. 10 shows an electrostatographic imaging apparatus according to a preferred embodiment of the invention. The imaging apparatus, designated generally by the numeral 500, is in the form of an electrophotographic imaging apparatus and more particularly a color imaging apparatus wherein color separation images are formed in each of four color modules and transferred in register from toner image-bearing members to a receiver member as the receiver member is moved through the apparatus while supported on a paper transport web (PTW) 516. The PTW may for example be polyethylene terephthalate or other plastic. A toner image-bearing member (TIBM) may comprise a PIFM or an ITM, and a toner image may be formed on it or transferred to it from another member. An example of a PTW is disclosed in Herrick et al., U.S. Pat. No. 6,016,415. The apparatus features four color modules although this invention is applicable to two or more such modules.

Each module (591B, 591C, 591M, 591Y) is of similar construction except that as shown one paper transport web 516 which may be in the form of an endless belt operates with all the modules and the receiver member is transported by the PTW 516 from module to module. The elements in FIG. 10 that are similar from module to module have similar reference numerals with a suffix of B, C, M and Y referring to the color module to which it is associated; i.e., black, cyan, magenta and yellow, respectively. Four receiver members or discrete sheets 512*a, b, c* and *d* are shown simultaneously receiving images from the different modules, it being understood as noted above that each receiver member may receive one color image from each module and that in this example up to four color images can be received by each receiver member. The movement of the receiver member with the PTW 516 is such that each color image transferred to the receiver member at the transfer nip of each module is a transfer that is registered with the previous color transfer so that a four-color image formed on the receiver member has the colors in registered superposed relationship on the receiver member. The receiver members are then serially detacked from the PTW and sent to a fusing station (not shown) to fuse or fix the dry toner images to the receiver member. The PTW is reconditioned for reuse by providing charge to both surfaces using, for example, opposed corona chargers 522, 523, which neutralize charge on the two surfaces of the PTW.

Each color module of FIG. 10 includes a double-sleeved primary image-forming member (DSPIFM), for example, a rotating drum labeled 503 B, C, M and Y, respectively. The drums rotate about their respective axes in the directions shown by the arrows. Each DSPIFM 503B, C, M and Y has a removable replaceable compliant inner sleeve member (ISM) in the form of a tubular endless belt, e.g., labeled 507B which is snugly and nonadhesively gripped by a removable replaceable outer photoconductive sleeve member (OSM) in the form of a tubular endless belt, e.g., labeled 509B, upon which a pigmented marking particle image, or a series of different color marking particle images, is formed. The inner sleeve 507B snugly and nonadhesively grips a core member (not shown in FIG. 10, but see for example FIG. 1). A preferred core member is rigid and is generally not solid throughout, but preferably includes a hollow metal tube made for example from aluminum, and may have interior structures which may include chambers, strengthening struts, and the like. The core member preferably has a runout of less than 80 micrometers, and more preferably less than 20 micrometers. In order to form images, the outer surface of the outer sleeve 509B of the PIFM is uniformly charged by a primary charger means such as a corona charging device 505 B, C, M and Y, respectively or other suitable charger such as roller chargers, brush chargers, etc. The uniformly charged surface is exposed by suitable exposure means, such as for example a laser 506 B, C, M and Y, respectively or more preferably an LED or other electro-optical exposure device or even an optical exposure device to selectively alter the charge on the surface of the PIFM to create an electrostatic latent image corresponding to an image to be reproduced. The electrostatic latent image is developed by application of pigmented marking particles to the latent-image-bearing photoconductive drum by a development station 581 B, C, M and Y, respectively. The development station is a particular color of pigmented toner marking particles associated respectively therewith. Thus, each module creates a series of different color marking particle images on the respective photoconductive drum. In lieu of a photoconductive drum, which is preferred, a photoconductive belt may be used.

Each marking particle image formed on a respective DSPIFM or toner-image-bearing member (TIBM) is transferred electrostatically to an outer surface of a respective double-sleeved secondary or intermediate image transfer member (DSITM), for example, a double-sleeved intermediate transfer drum 508 B, C, M and Y, respectively. After transfer of the toner image the residual toner is cleaned from the surface of the photoconductive drum by a suitable cleaning device 504 B, C, M and Y, respectively to prepare the surface for reuse for forming subsequent toner images. The cleaning device may comprise preferably a cleaning brush but could also be a blade or web cleaner.

Each DSITM 508 B, C, M and Y has a removable replaceable compliant inner sleeve member (ISM) in the form of a tubular endless belt, e.g. labeled 541B which is snugly and preferably nonadhesively gripped by a removable replaceable outer compliant sleeve member (OSM) also in the form of a tubular endless belt, e.g. labeled 542B. It is preferable that the OSM is stretched under tension in order to effect a tight grip of the ISM. The inner sleeve 541B snugly and preferably nonadhesively grips a highly toleranced substantially cylindrical core member (not shown in FIG. 10). It is preferable that the ISM is stretched under tension in order to effect a tight grip of the core member. A preferred core member is rigid and is generally not solid throughout, but preferably includes a hollow metal tube made for example from aluminum, and may have interior structures which may include chambers, strengthening struts, and the like. The core member preferably has a runout of less than 80 micrometers, and more preferably less than 20 micrometers.

Inner sleeve member 541B located on intermediate transfer drum 508B and inner sleeve member 507B located on photosensitive drum 503B have generally similar structures (see, for example, FIG. 1), yet may differ in composition, dimensions and electrical properties. Each ISM includes a strengthening band, a compliant layer coated on the strengthening band, and a protective layer coated on or in intimate contact with the compliant layer. An inner sleeve compliant layer (ISCL) is formed of an elastomer such as a polyurethane or other materials well noted in the published literature. The primary function of an inner sleeve member is to provide macrocompliance.

A strengthening band (SB) of an ISM may be rigid or flexible, and preferably has a Young's modulus less than 300 GPa (1 GPa=1 GigaPascal=$10^9$ Newton/$m^2$). The SB has a thickness preferably in a range 1–500 micrometers and more preferably, in a range 5–150 micrometers. A strengthening band may be comprised of any suitable material, including metal, elastomer, a copolymer, a plastic or other material, a fabric, or a reinforced material including a filler or fibers such as, for example, a reinforced silicone belt. An SB may be provided with a high surface energy on its outer surface prior to forming the ISCL layer on it, and may also be provided with a low surface energy inner surface which is in contact with the core member. It is preferred that a strengthening band be a tubular endless belt, which may for example be woven, extruded, electroformed, or fabricated from a sheet by using, for example, ultrasonic welding or an adhesive. More preferably, an SB is seamless. When a core member is electrically biased in order to provide an electric field for transfer of a toner image, it may be required to coat the inner surface of the strengthening band (closest to the core member) with a conductive material to improve electrical contact with the central member and also to ensure a uniform electrical potential at all points on the underside of the inner sleeve member.

The inner sleeve compliant layer may be coated on the strengthening band by first mounting the SB on a mandrel. Preferably, the ISCL has a thickness in a range 5–20 mm and more preferably 2–10 mm, and a Young's modulus preferably less than about 10 MPa, and more preferably in a range 1–5 MPa. The ISCL is preferably formed of a polymeric material, e.g., an elastomer such as a polyurethane or other materials well noted in the published literature. The ISCL may comprise a material having one or more phases, e.g., a foam or a dispersion of one solid phase in another. Preferably, the ISCL has a Poisson's ratio in a range 0.2–0.5, and more preferably the ISCL has a Poisson's ratio in a range 0.45–0.5, and a preferred material is a polyurethane with a Poisson's ratio of about 0.495.

The protective layer (PL) on the outer surface of an ISM is preferably made from any suitable material, which is flexible and hard. It is preferred that the protective layer comprise a coating of a synthetic material, preferably a cerarner or a sol-gel, applied to the thick compliant layer by any suitable coating method. Alternatively, the PL may comprise a thin metal band, e.g., nickel, which may be adhered to the ISCL or which may be in the form of an endless belt under tension applied to the outer surface of the ISCL by, for example, using compressed air assist, or by cooling the SB plus its ISCL coating in order to shrink it so as to slide on the endless metal belt. A protective layer of an inner sleeve member has a thickness preferably in a range 1–50 micrometers and more preferably in a range 1–50 micrometers, and has a Young's modulus preferably greater than 100 MPa and more preferably in a range 0.5–20 GPa. It may be desired that a stiffening layer act as a PL, in which case the PL preferably has a Young's modulus greater than 0.1 GPa and more preferably 50–300 GPa, and a thickness in a range 10–200 micrometers.

Figure 2:
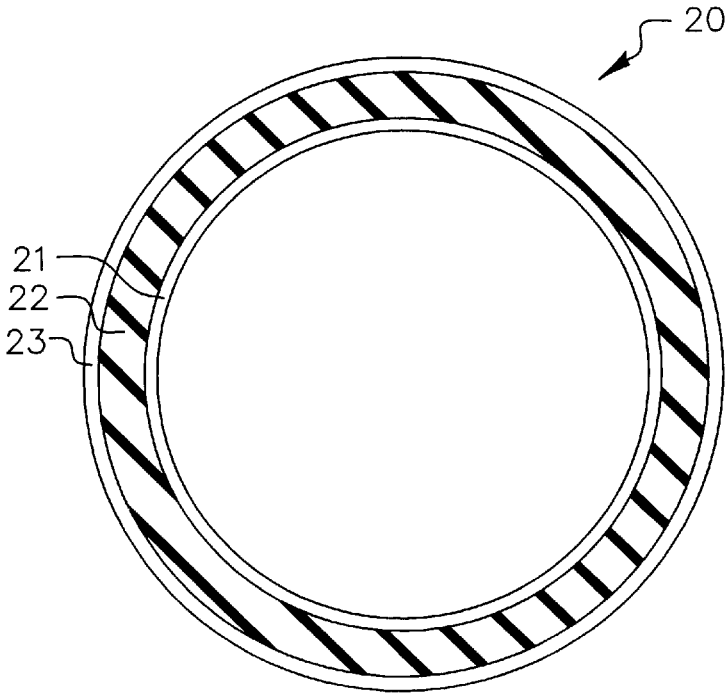
FIG. 2 illustrates a cross-sectional view of a preferred embodiment of an outer sleeve of an intermediate transfer member of the invention.

Outer sleeve member (OSM) 542B located on the intermediate transfer drum 508B includes a stiffening layer (SL), an outer sleeve compliant layer (OSCL) coated on the SL, and a release layer coated on the OSCL (see for example FIG. 2). The OSM provides microcompliance to the DSITM. The stiffening layer of the OSM preferably has the form of a tubular endless belt. More preferably, the stiffening layer is a seamless belt. The primary function of the SL is to minimize hoop strain in the underlying ISM 541B, thereby helping to reduce or make negligible the variations in overdrive caused by roller runout, or variations in overdrive caused by the alignment tolerances in the engagement of each pair of DSPIFM and DSITM drums. The SL also functions to reduce registration errors by reducing, or making negligible, module-to-module variations in overdrive. Preferably, the stiffening layer (SL) includes any suitable metal, e.g., steel, nickel, or other high tensile metal. Less preferably, the SL may comprise an elastomer such as for example a polyurethane, a polyimide, a polyamide or a fluoropolymer, the elastomer having a yield strength which is not exceeded during operation of the DSITM. The SL may also comprise a fabric or a reinforced material, or it may comprise a sol-gel or a ceramer having a yield strength, which is not exceeded during operation of the DSITM. Preferably, the stiffening layer is made of nickel, e.g., in the form of a suitably thin electroformed seamless nickel belt available for example from Stork Screens America, Inc., of Charlotte, N.C. A stiffening layer of OSM 542 B, C, Y, M preferably has a thickness less than about 500 micrometers, more preferably in a range 10–200 micrometers. The stiffening layer also has a Young's modulus preferably greater than about 0.1 GPa, more preferably in a range 50–300 GPa.

The outer sleeve compliant layer (OSCL) of outer sleeve member 542 B, C, Y, M includes bulk compositional and mechanical properties having the same ranges of utilization as those disclosed above for the compliant layers included in the inner sleeve members of rollers 503B and 508B. The preferred thickness of the OSCL is in a range 0.5–2.0 mm. In order to provide a suitable resistivity, the elastomer including the OSCL may be doped with sufficient conductive material (such as antistatic particles, ionic conducting materials, or electrically conducting dopants) to have a relatively low resistivity. The OSCL should have a bulk electrical resistivity preferably in a range $10^7$–$10^{11}$ ohm-cm, more preferably about $10^9$ ohm-cm. The OSCL may be coated on the stiffening layer by first mounting the SL on a mandrel. Subsequently, the release layer may then be coated on the OSCL.

The release layer of the outer sleeve member 542 B, C, Y, M preferably includes a synthetic material such as a sol-gel, a ceramer, a polyurethane or a fluoropolymer, but other materials having good release properties including low surface energy materials may also be used. The release layer has a Young's modulus greater than 100 MPa, preferably 0.5–20 GPa, and a thickness preferably, in a range 1–50 micrometers, more preferably 1–50 micrometers. The release layer has a bulk electrical resistivity preferably in a range $10^7$–$10^{13}$ ohm-cm, more preferably about $10^{10}$ ohm-cm.

An electrical bias is typically applied to the DSITM drum 508 B in order to effect electrostatic transfer of a toner image from the DSPIFM drum 503 B. It is preferred to apply the electrical bias to the stiffening layer of the OSM 542B by connecting it to an electrical source of voltage or current, in which case the SL preferably has a bulk or volume electrical resistivity of less than about $10^{10}$ ohm-cm. More preferably, the SL is conductive. However, in some applications it may be desirable to use a non-conductive SL, in which case the SL may be coated with a thin conductive material, e.g., a metallic film applied to the SL, which is connected to an electrical source of voltage or current. In other applications, it may be desirable to apply the electrical bias to the core member of DSITM drum 508 B, rather than to the SL of OSM 541B, i.e., preferably to a metallic or conductive core or else to a conductive material coated on the core, e.g., a thin metallic film applied to the surface of a non-conductive core. When the electrical bias is applied to the core member, which is generally less preferred, both the ISCL and the protective layer of ISM 541B should be provided with suitable resistivities, the ISCL having a bulk or volume resistivity preferably in a range $10^7$–$10^{11}$ ohm-cm and more preferably about $10^9$ ohm-cm, and the protective layer having a bulk or volume electrical resistivity of less than about $10^{10}$ ohm-cm.

Figure 3:
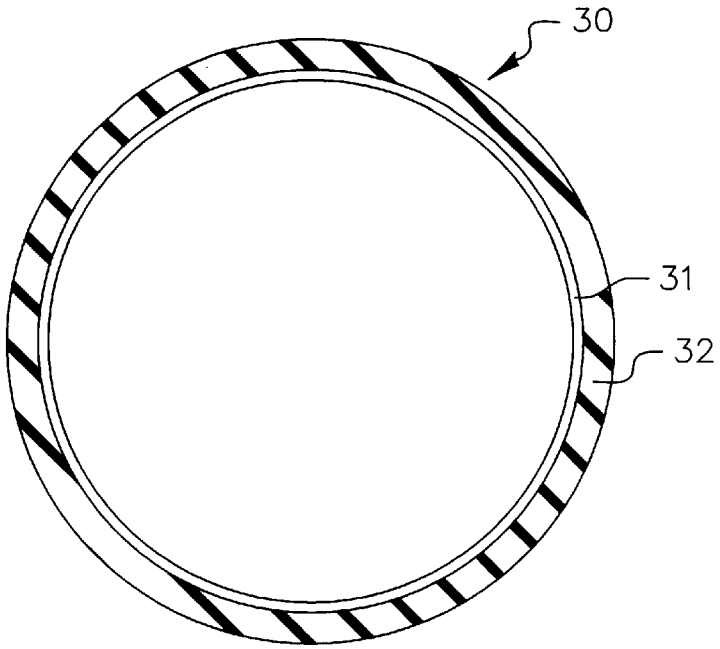
FIG. 3 illustrates a cross-sectional view of an outer sleeve of a primary image-forming member of the invention.

An outer sleeve member 509B located on the DSPIFM drum 503B includes a stiffening layer (SL) and a photoconductive structure coated on the SL (see for example FIG. 3). The SL is preferably conductive. The photoconductive structure may include one or more layers which may comprise any known suitable photoconductive material, such as for example, an inorganic material or dispersion, a homogeneous organic photoconductive layer, an aggregated organic photoconductive layer, a composite structure including a charge generating layer (CGL) plus a charge transport layer (CTL), and the like. In order to effect electrostatic transfer of a toner image from DSPIFM drum 503 B to DSITM drum 508B, it is preferred to connect the stiffening layer of OSM 542B to ground potential, in which case the SL preferably has a bulk or volume electrical resistivity of less than about $10^{10}$ ohm-cm. However, in some applications it may be desirable to use a non-conductive SL, in which case the SL may be coated with a thin conductive material, e.g., a metallic film applied to the surface of the SL, which is connected to ground potential.

Figure 4A:
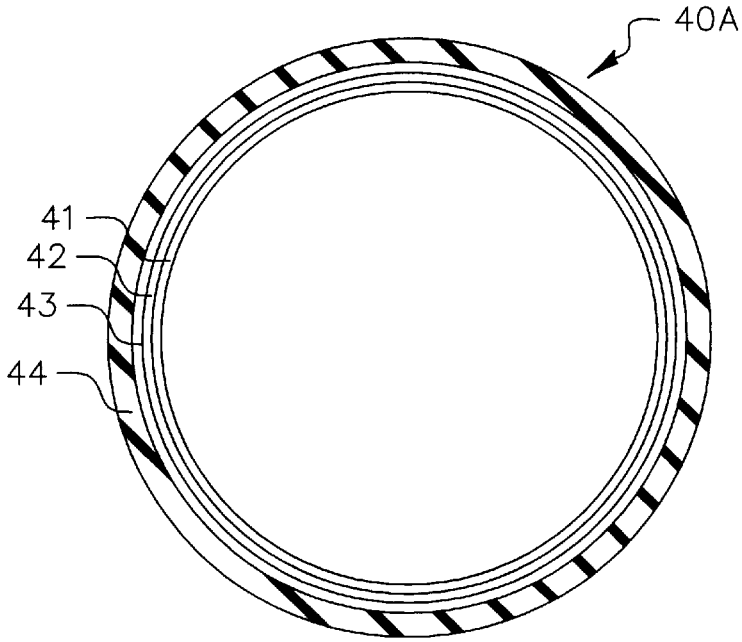
FIG. 4(*a*) illustrates a cross-sectional view of a preferred embodiment of an outer sleeve of a primary image-forming member of the invention including a photoconductive composite layer structure.

A preferred outer sleeve member 509B located on the PIFM drum 503B includes a stiffening layer (SL), a barrier layer coated on the SL, a charge generating layer (CGL) coated on the barrier layer, and a charge transport layer (CTL) coated on the CGL [see for example FIG. 4(*a*)]. The stiffening layer of the outer sleeve member 509B preferably has the form of a tubular seamless endless belt. In addition to minimizing hoop strain in the underlying inner sleeve member 507B (similar to the effect produced by the SL of the OSM 542B of roller 508B) the SL of OSM 509B provides a suitable substrate on which to successively coat the CGL and the CTL. Preferably, the stiffening layer is thin and flexible and includes any suitable conductive material, such as a metal, e.g., steel, nickel, or other high tensile metal. Less preferably, the SL may comprise an elastomer such as for example a polyurethane doped with a conductive material such as an antistat, or a synthetic polymeric or plastic material including a dispersion of conductive particles having a volume fraction above the percolation threshold, the SL having a yield strength which is not exceeded during operation of the DSPIFM. Preferably, the stiffening layer is made of nickel. A stiffening layer of OSM 509 B, C, Y, M has a thickness less than about 500 micrometers, preferably in a range 10–200 micrometers. The stiffening layer also has a Young's modulus greater than about 0.1 GPa, preferably in a range 50–300 GPa.

A preferred photoconductive OSM 509B includes a stiffening layer in the form of an electroformed seamless nickel belt 0.005 inch thick available, e.g., from Stork Screens America, Inc., of Charlotte, N.C. The photoconductive structure coated on the SL includes: a polyamide resin barrier layer 0.5–1.0 micrometers thick coated on the SL; a CGL of the type described by Molaire et al. in U.S. Pat. No. 5,614,342 including a co-crystal dispersion with the CGL coated on the barrier layer, the CGL having a thickness in a range 0.5–1.0 micrometer and preferably about 0.5 micrometer; and a CTL, coated on the CGL, having thickness 12–35 micrometers and preferably about 25 micrometers, the CTL including 2 parts by weight of tritolylamine and 2 parts by weight 1,1-bis{4-(di4-tolylamino) phenyl}methane in a binder consisting of 1 part by weight poly[4,4'-(2-norbornylidene)bisphenol terephthalate-co-azelate-(60/40)] and 5 parts by weight Makrolon™ polycarbonate obtainable from General Electric Company, Schenectady, N.Y.

In another preferred embodiment, microcompliance can be provided to the outer sleeve member 509B by including a thin compliant layer coated on the SL underneath the CGL and the CTL coatings, the compliant layer having a thickness preferably in a range 0.5–2.0 mm. The preferred electrical and physical properties are similar to those of the compliant layer of the OSM 542B. Preferably, a thin conductive layer, e.g., of nickel, is coated on top of the thin compliant layer, upon which are successively coated a barrier layer, a CGL, and a CTL, as described above [see for example FIG. 4(*b*)]. The thin conductive layer may be grounded during operation.

In some applications an optional thin hard layer may be provided as an exterior coating outside the CTL to provide improved wear resistance, such as for example including a sol-gel, silicon carbide, diamond-like carbon, or the like.

Using a DSITM roller, according to the invention, having a relatively conductive structure, transfer of the single-color marking particle images from the DSPIFM roller to the outer surface of the DSITM can be accomplished with a relatively narrow nip width (preferably 2–15 mm and more preferably 3–8 mm) and a relatively modest potential of, for example, 600 volts or less of a suitable polarity applied by connecting a potential source (not shown) preferably to the stiffening member of the OSM of each DSITM.

A single-color marking particle image respectively formed on the OSM 542B (others not identified) of each double-sleeved intermediate image transfer member drum, is transferred to a toner image receiving surface of a receiver member, which is fed into a nip between the intermediate image transfer member drum and a transfer backing roller (TBR) 521B, C, M and Y, respectively, that has an outer resistive blanket and is suitably electrically biased by power supply 552 to induce the charged toner particle image to electrostatically transfer to a receiver sheet. The receiver member is fed from a suitable receiver member supply (not shown) and is suitably "tacked" to the PVW 516 and moves serially into each of the nips 510B, C, M and Y where it receives the respective marking particle image in suitable registered relationship to form a composite multicolor image. As is well known, the colored pigments can overlie one another to form areas of colors different from that of the pigments. The receiver member exits the last nip and is transported by a suitable transport mechanism (not shown) to a fuser where the marking particle image is fixed to the receiver member by application of heat and/or pressure and, preferably both. A detack charger 524 may be provided to deposit a neutralizing charge on the receiver member to facilitate separation of the receiver member from the belt 516. The receiver member with the fixed marking particle image is then transported to a remote location for operator retrieval. The respective DSITMs are each cleaned by a respective cleaning device 511B, C, M and Y to prepare it for reuse. A preferred cleaning device is a brush cleaner although blade and web cleaners may also be used.

Appropriate sensors (not shown) of any well-known type, such as mechanical, electrical, or optical sensors for example, are utilized in the imaging apparatus 500 to provide control signals for the apparatus. Such sensors are located along the receiver member travel path between the receiver member supply through the various nips to the fuser. Further sensors may be associated with the primary image forming member photoconductive drum, the intermediate image transfer member drum, the transfer-backing member, and various image-processing stations. As such, the sensors detect the location of a receiver member in its travel path, and the position of the primary image forming member photoconductive drum in relation to the image forming processing stations, and respectively produce appropriate signals indicative thereof. Such signals are fed as input information to a logic and control unit LCU including a microprocessor, for example. Based on such signals and a suitable program for the microprocessor, the control unit LCU produces signals to control the timing operation of the various electrographic process stations for carrying out the imaging process and to control drive by motor M of the various drums and belts. The production of a program for a number of commercially available microprocessors, which are suitable for use with the invention, is a conventional skill well understood in the art. The particular details of any such program would, of course, depend on the architecture of the designated microprocessor.

Figure 13:
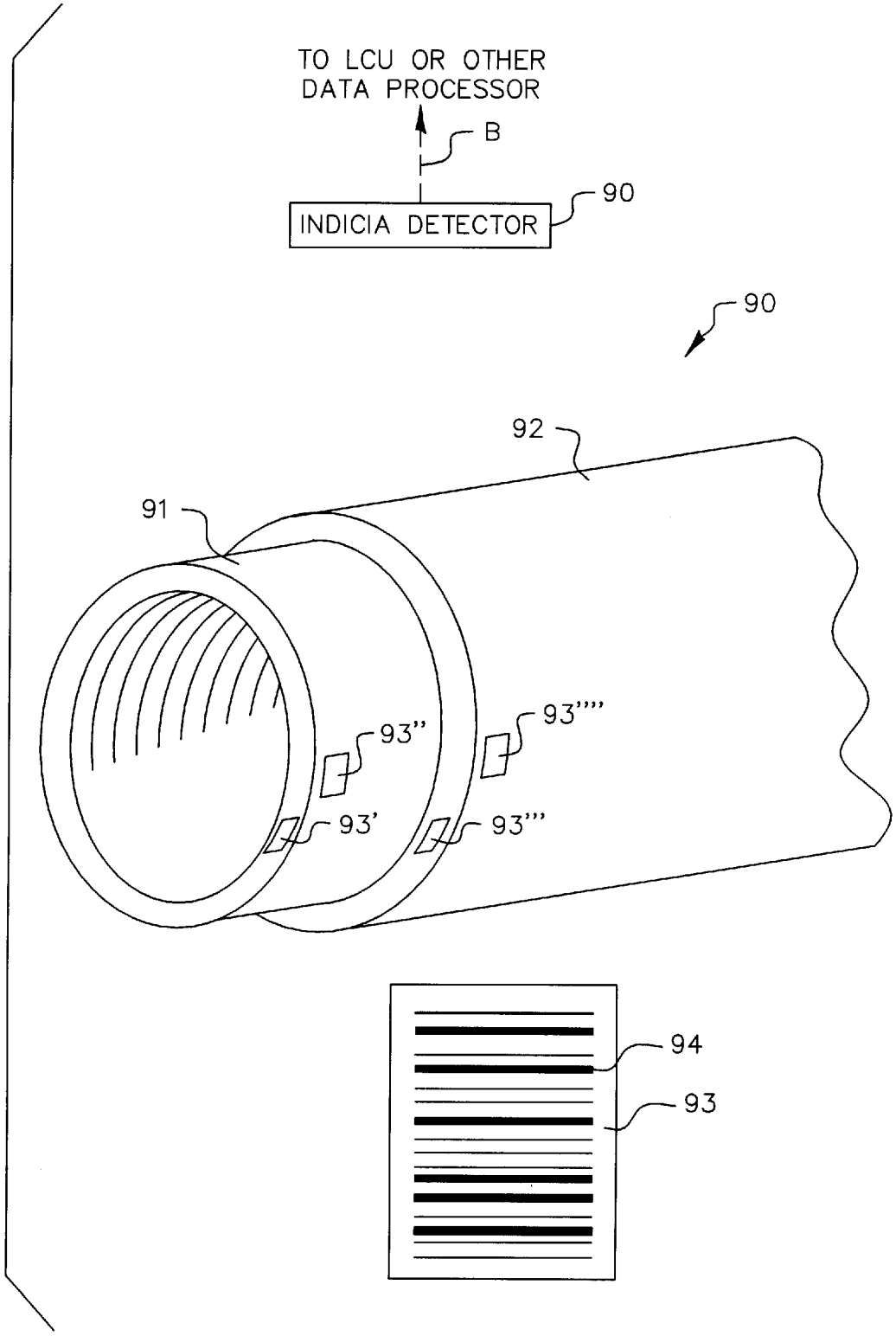
FIG. 13 is a sketch of an assembly of cutaway portions of both sleeves of an inventive double-sleeved roller (core member not shown) wherein the inner sleeve member has marked on it descriptive indicia located on the outer surface of the inner sleeve member in a small area located close to an end of the inner sleeve member, and the outer sleeve member has marked on it descriptive indicia located on the outer surface of the outer sleeve member in a small area located close to an end of the outer sleeve member, where for clarity of explanation the outer sleeve member is shown displaced a short distance with respect to the inner sleeve member in order to reveal a location for an indicia on an outside portion of the inner sleeve member.

FIG. 13 is a sketch of a cutaway end portion of an assembly, indicated as 90, of both inner and outer sleeves concentrically disposed of an inventive double-sleeved roller (core member not shown). An inner sleeve member 91 has marked on it descriptive indicia located on the outer surface of the ISM in a small area located close to an end of the ISM, and an outer sleeve member 92 has marked on it descriptive indicia located on the outer surface of the OSM in a small area located close to an end of the OSM. For clarity of explanation, the outer sleeve member is shown displaced from its operational location by a short distance with respect to the inner sleeve member in order to reveal a location for an indicia on an outside portion of the ISM. The indicia are provided on the inner sleeve member to indicate a parameter relative to the inner sleeve, and are also provided on the outer sleeve member to indicate a parameter relative to the outer sleeve. With reference to FIG. 13, entities shown therein that are similar to one another are identified with one or more primes (') after the reference numbers. The indicia on the inner sleeve member, i.e., a set of descriptive markings, may be located in a small area 93" located on a cylindrical portion of the inner sleeve member close to an end of the inner sleeve member. More preferably, the indicia on the inner sleeve member are contained in a small area 93' located on an end of sleeve 91 (the individual layers including sleeve 91 are not shown). The indicia on the outer sleeve member, i.e., a set of descriptive markings, are preferably located in a small area 93"" located on a cylindrical portion of the outer sleeve member close to an end of the outer sleeve member. Alternatively, because of the relative thinness of the outer sleeve member, the indicia on the outer sleeve member may be contained in a small area 93"' located on an end of sleeve 92 (the individual layers including sleeve 92 are not shown). An enlarged view 93 of any one of the small areas 92', 92", 93"' or 92"" illustrates that the descriptive indicia may be in the form of a bar code, as indicated by the numeral 94, which may be read, for example, by a scanner. The scanner may be mounted in an electrophotographic machine so as to monitor a double-sleeved roller, e.g., during operation of the machine or during a time when the machine is idle, or the scanner may be externally provided during installation of, or maintenance of, an inventive roller. Generally, the indicia may be read, sensed or detected by an indicia detector 95. As indicated in FIG. 13 by the dashed arrow labeled B, the analog or digital output of the indicia detector may be sent to a logic control unit (LCU) incorporated in an electrostatographic machine utilizing an inventive ITM roller, or it may be processed externally, e.g., in a portable computer during the installation or servicing of an inventive ITM roller, or it may be processed in any other suitable data processor. The indicia may be read optically, magnetically, or by means of radio frequency. In addition to a bar code 94, the indicia may comprise any suitable markings, including symbols and ordinary words, and may be color coded. The indicia may also be read visually or interpreted by eye. Suitable materials for the indicia are for example inks, paints, magnetic materials, reflective materials, and the like, which may be applied directly to the surface of the sleeve member. Alternatively, the indicia may be located on a label that is adhered to the outer surface of the sleeve member. The indicia may also be in raised form or produced by stamping with a die or by otherwise deforming a small local area on the outer surface of the sleeve member, and the deformations may be sensed mechanically or otherwise detected or read using an indicia detector 95 in the form of a contacting probe or by other mechanical means. It may also be desirable for some applications to place indicia on the inner surface of a sleeve member, or on the outer surface of the central member. It may also be desirable to provide a cutaway or an opening in outer sleeve member 92 so that an indicia located in an area 93" on sleeve 91 may be detected when the outer sleeve is located in operational position, and not displaced as shown in FIG. 13.

Different types of information may be encoded or recorded in the indicia. For example, the outside diameter of a roller, i.e., the outside diameter of the outer sleeve member may be recorded so that nip width or registration parameters can be accordingly adjusted. The effective resistivity in a radial direction of an inner or outer sleeve may be recorded in the indicia so that the electrical bias applied to the roller may be suitably adjusted for optimal performance. The effective hardness and effective Young's modulus of a sleeve of an inventive roller may be recorded in the indicia so that nip widths may be suitably adjusted. The date of manufacture of either sleeve of the roller may be recorded in the indicia for diagnostic purposes, so that the end of useful life of the given sleeve could be estimated for timely replacement. Specific information for each given roller regarding the roller runout, e.g., as measured after manufacture, may also be recorded in the indicia, and this information could be used for optimizing registration, e.g., between modules. Moreover, the orientation of an inventive roller, such as for example a skew between an inventive roller and a primary imaging roller, may be described by the indicia.

When the outside diameter of the OSM of an inventive double-sleeved ITM roller is recorded in the indicia, the information may be used to speed the calibration time of a registration system as explained below. For example, the registration system may utilize a software algorithm that controls the speed of the start-of-line clock signal fed to an LED writehead. A separate start-of-line clock signal is used for each color module, each controlling the length of the color toner image of the respective color separation image produced by each module, thereby ensuring that the color toner image length is correct and uniform throughout the image. It is known that, in general, a change in the engagement between a primary imaging roller and an ITM roller changes the speed ratio, thereby altering the length of the image, e.g., by stretching or compressing it as the engagement is increased or decreased. ITM sleeve members cannot be manufactured practically with identical outside diameters, a typical variation being ±50 micrometers. A small difference in the diameter of a newly installed ITM sleeve of an inventive double-sleeved roller will, therefore, effectively change the engagement between the primary imaging and ITM rollers. Similarly, a small difference in the diameter of a newly installed PIFM sleeve of an inventive double-sleeved photoconductive roller will effectively change the engagement between the primary imaging and ITM rollers. By utilizing the diameter information of a newly installed outer sleeve, the registration unit can immediately correct the start-of-line clock signal so that the image length and uniformity is maintained correctly. This adjustment of the parameters in the algorithm controlling the start-of-line clock signal is one of several parameters that need to be controlled to ensure accurate registration of each digital image written by the writehead. Prior knowledge of the outside diameter of an inventive double-sleeved roller given in the indicia speeds the calibration time of the registration system.

The receiver members utilized with the reproduction apparatus 500 can vary substantially. For example, they can be thin or thick paper stock, including textured or embossed paper or other textured or embossed materials, or transparency stock, e.g., plastic sheets. As the thickness and/or bulk resistivity of the receiver member stock varies, the resulting change in impedance affects the electric field used in the nips 510B, C, M, Y to urge transfer of the marking particles to the receiver members. Moreover, a variation in relative humidity will vary the conductivity of a paper receiver member, which also affects the impedance and hence changes the transfer field. To overcome these problems, the paper transport belt preferably includes certain characteristics.

The endless belt or web (PITW) 516 is preferably comprised of a material having a bulk electrical resistivity greater than $10^5$ ohm-cm and where electrostatic hold down of the receiver member is not employed, it is more preferred to have a bulk electrical resistivity of between $10^8$ ohm-cm and $10^{11}$ ohm-cm. Where electrostatic hold down of the receiver member is employed, it is more preferred to have the endless web or belt have a bulk resistivity of greater than $1\times10^{12}$ ohm-cm. This bulk resistivity is the resistivity of at least one layer if the belt is a multilayer article. The web material may be of any of a variety of flexible materials such as a fluorinated copolymer (such as polyvinylidene fluoride), polycarbonate, polyurethane, polyethylene terephthalate, polyimides (such as Kapton™), polyethylene napthoate, or silicone rubber. Whichever material that is used, such web material may contain an additive, such as an anti-stat (e.g. metal salts) or small conductive particles (e.g. carbon), to impart the desired bulk resistivity for the web. When materials with high bulk resistivity are used (i.e., greater than about $10^{11}$ ohm-cm), additional corona charger(s) may be needed to discharge any residual charge remaining on the PTW once the receiver member has been removed. The PTW may have an additional conducting layer beneath the resistive layer which is electrically biased to urge marking particle image transfer, however, it is more preferable to have an arrangement without the conducting layer and instead apply the transfer bias through either one or more of the support rollers or with a corona charger. The endless belt is relatively thin (20 micrometers–1000 micrometers, preferably, 50 micrometers–200 micrometers) and is flexible. It is also envisioned that the invention applies to an electrostatographic color machine wherein a generally continuous paper web receiver is utilized and the need for a separate paper transport web is not required. Such continuous webs are usually supplied from a roll of paper that is supported to allow unwinding of the paper from the roll as the paper passes as a generally continuous sheet through the apparatus.

In feeding a receiver member onto belt 516 charge may be provided on the receiver member by charger 526 to electrostatically attract the receiver member and "tack" it to the belt 516. A blade 527 associated with the charger 526 may be provided to press the receiver member onto the belt and remove any air entrained between the receiver member and the belt.

A receiver member may be engaged at times in more than one image transfer nip and preferably is not in the fuser nip and an image transfer nip simultaneously. The path of the receiver member for serially receiving in transfer the various different color images is generally straight facilitating use with receiver members of different thicknesses.

The endless paper transport web (PTW) 516 is entrained about a plurality of support members. For example, as shown in FIG. 10, the plurality of support members are rollers 513, 514 with preferably 513 being driven as shown by motor M (of course, other support members such as skis or bars would be suitable for use with this invention). Drive to the PTW can frictionally drive the DSITM rollers to rotate the DSITMs which in turn causes the DSPIFM rollers to be rotated, or additional drives may be provided. The process speed is determined by the velocity of the PTW, which may be any useful velocity, typically about 300 mm $sec^{-1}$.

Support structures 575*a, b, c, d* and *e* are provided before entrance and after exit locations of each transfer nip to engage the belt on the backside and alter the straight line path of the belt to provide for wrap of the belt about each respective ITM roller so that there is wrap of the belt of greater than 1 mm on each side of the nip (pre-nip and post-nip wraps) or at least one side of the nip and preferably the total wrap is less than 20 mm. The nip is where the pressure roller contacts the backside of the belt or where no pressure roller is used, where the electrical field is substantially applied. However, the image transfer region of the nip is a smaller region than the total wrap. The wrap of the belt about the DSITM roller also provides a path for the lead edge of the receiver member to follow the curvature of the DSITM but separate from engagement with the DSITM while moving along a line substantially tangential to the surface of the cylindrical DSITM. Pressure applied by the transfer backing rollers (TBRs) 521 B, C, M and Y is upon the backside of the belt 516 and forces the surface of the compliant DSITM to conform to the contour of the receiver member during transfer. Preferably, the pressure of each TBR 521 B, C, M and Y on the PTW 516 is 7 pounds per square inch or more. The TBRs may be replaced by corona chargers, biased blades, or biased brushes. Substantial pressure is provided in the transfer nip to realize the benefits of the compliant intermediate transfer member, which are conformation of the toned image to the receiver member and image content on both a microscopic and macroscopic scale. The pressure may be supplied solely by the transfer biasing mechanism or additional pressure applied by another member such as a roller, shoe, blade or brush.

It is to be understood in FIG. 10 that the amount of pre-nip wrap and post-nip wrap may be set to any convenient values in any of the modules, and may be made to differ module to module by adjustments of the individual elevations of individual support structures or by placing the support structures at points that are not half-way between modules, or both. Moreover, in order to have independent control of the amounts of pre-nip and post-nip wrap within each module, a larger number of support structures may be used, e.g., two support structures per module, one on each side of each transfer nip. Support structures may include skids, bars, rollers, and the like.

Figure 11:
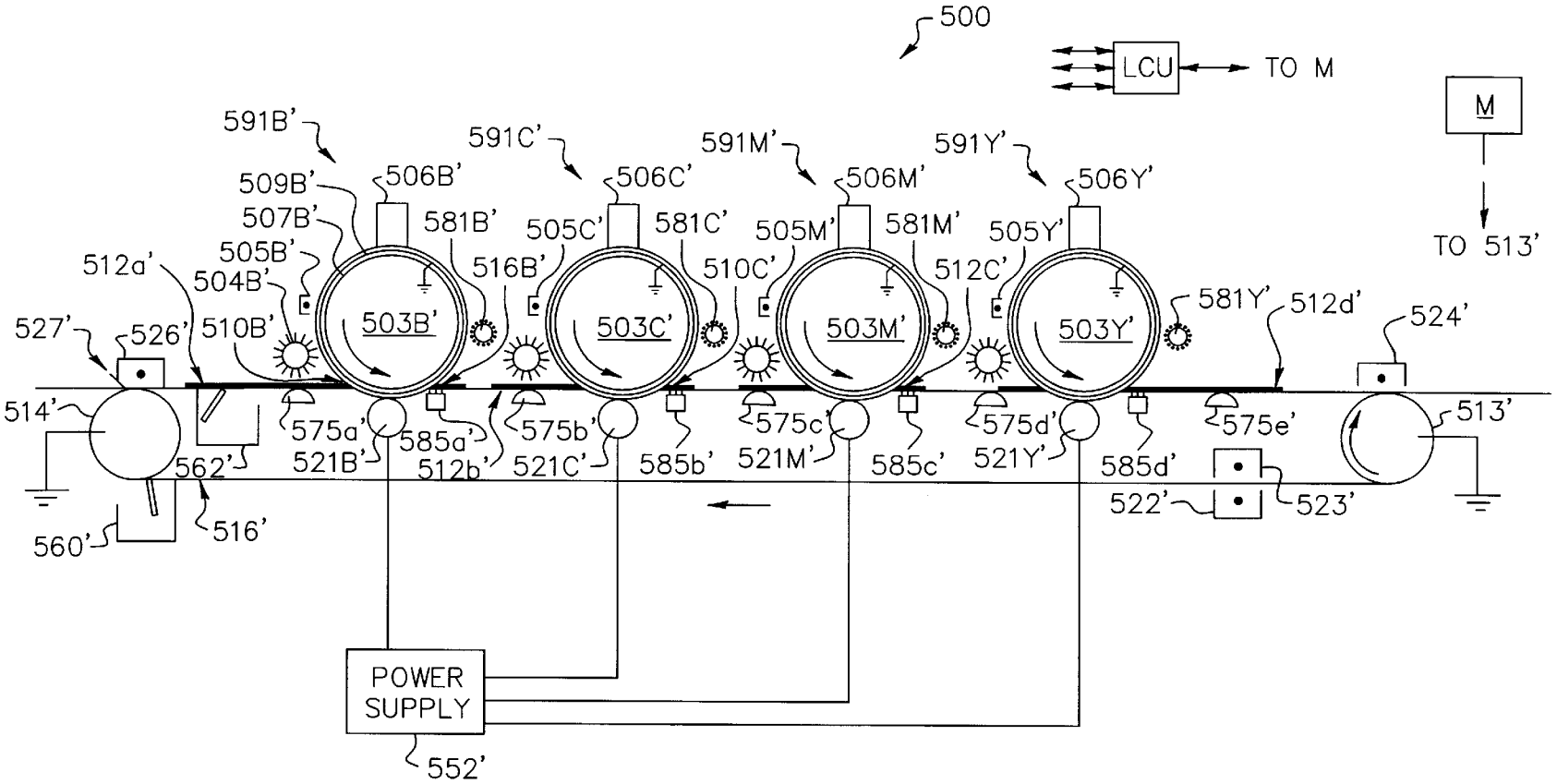
FIG. 11 is a generally schematic side elevational view of an imaging apparatus utilizing four modules, each module including a double-sleeved compliant photoconductive primary image-forming member with an endless web and web-driving mechanism for facilitating electrostatic transfer of a single-color toner image from the PIFM roller to a receiver member adhered to and carried by the endless web through each of the four modules, only basic components being shown for clarity of illustration.

With reference to FIG. 11, structures shown therein that are similar to structure in FIG. 10 are identified with a prime (') after the reference numbers. In the embodiment of FIG. 11, a toner color separation image of one of each of four colors is formed by each module 591B', 591C', 591M', and 591Y' on respective double-sleeve PIFMs such as photoconductive drums 503B', 503C', 503M' and 503Y', each drum including a removable replaceable ISM and a removable replaceable OSM. The respective toned color separation images are transferred in registered relationship to a receiver member as the receiver member serially travels or advances from module to module receiving in transfer at each transfer nip (510B' is the only nip designated) a respective toner color separation image. In the embodiment of FIG. 11, the DSITMs are not present and direct transfer of each image is made from the respective double-sleeved photoconductive drums to the receiver sheet as the receiver sheet serially advances through the transfer stations while supported by the paper transport web 516'. In the preferred embodiment for direct transfer of toner images from DSPIFMs to receiver sheets, microcompliance is provided to the OSM 509B' by including a compliant layer coated on the SL underneath the CGL and the CTL coatings, the compliant layer having a thickness preferably in a range 0.5–2.0 mm. The preferred electrical and physical properties are similar to those of the compliant layer of the OSM 542B. A thin conductive layer, e.g., of nickel, may be coated on top of the compliant layer, upon which are successively coated a barrier layer, a CGL, and a CTL, as described above. The thin conductive layer may be grounded during operation.

Figure 12:
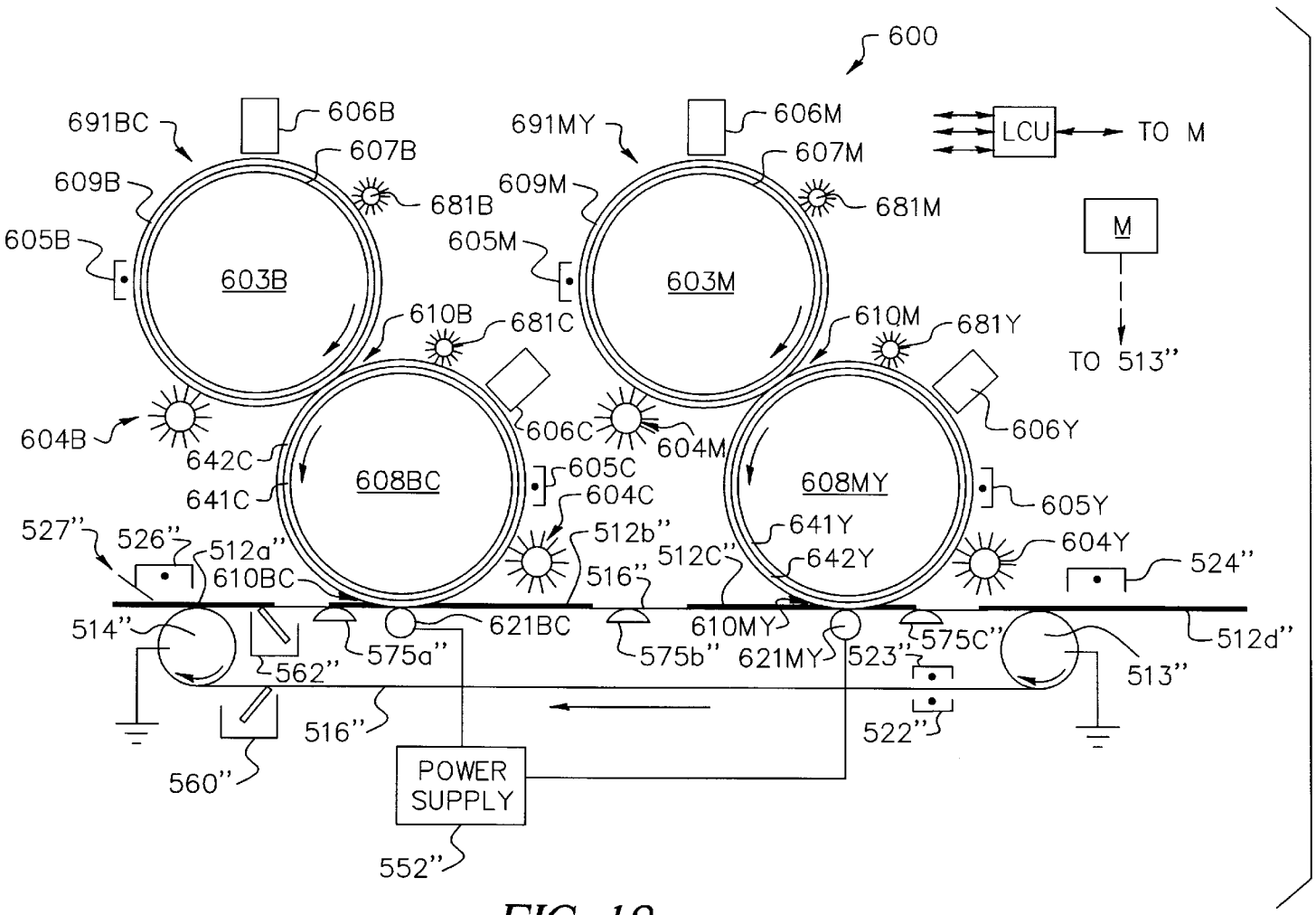
FIG. 12 is a generally schematic side elevational view of an imaging apparatus utilizing two modules, each module including a double-sleeved photoconductive primary image-forming member from which a first color toner image is electrostatically transferred in registry on to a second color toner image located on a double-sleeved bifunctional roller including a stiffening layer and a photoconductive layer or layers, the second color toner image priorly created electrophotographically on the double-sleeved bifunctional roller, with an endless web and web-driving mechanism for facilitating electrostatic transfer of the superposed first and second color toner images from the ITM roller to a receiver member adhered to and carried by the endless web through each of the two modules, only basic components being shown for clarity of illustration.

In another preferred embodiment, the number of modules required for full color imaging is reduced by providing a photoconductive OSM of a compliant DSITM. With reference to FIG. 12, structures shown therein that are similar to structures in FIGS. 10 and 11 are identified with a double prime (") after the reference numbers. In the embodiment of FIG. 12, an apparatus designated by the numeral 600 includes two modules 691BC and 691MY, although a different number of modules may be employed. Each module is of similar construction except that as shown one paper transport web 516" which may be in the form of an endless belt operates with all the modules, and receiver members 512*a*", 512*b*", 512*c*" and 512*d*" are transported by the PTW 516" from module to module. Module 691BC, for example, includes a rotating photoconductive DSPIFM drum 603B engaging a counter-rotating photoconductive DSITM drum 608BC in a pressure nip indicated by the label 610B, the drum 608BC engaged in a pressure nip indicated as 610BC produced by TBR 621BC behind the paper transport web 516", the PTW frictionally driving the drum 608BC which in turn drives drum 603B. Alternatively in addition to frictional drive a motor drive may be used to supplement the drive to a drum. Movement of PTW 516" is indicated by an arrow and is driven by drive to roller 513". DSPIFM drum 603B includes a rigid core member (not shown in FIG. 12), a removable replaceable compliant ISM 607B preferably nonadhesively gripping and surrounding the core member, and a removable replaceable photoconductive OSM 609B preferably nonadhesively gripping and surrounding the ISM. Photoconductive DSITM 608BC includes a rigid core member (not shown in FIG. 12), a removable replaceable macrocompliant ISM 641C preferably nonadhesively gripping and surrounding the core member, and a removable replaceable microcompliant photoconductive OSM 642C preferably nonadhesively gripping and surrounding the ISM. Drums 603B and 608BC have material characteristics similar to those for drums 503B, C, M and Y described above. On each of the drums 603B, 608BC, 603M and 608MY a different single-color toner image is formed, made for example from black, cyan, magenta, and yellow toners indicated by the letters B, C, M, and Y, respectively, or from different colors, or a different number of colors. Also, toners including non-color attributes may be used. In module 691BC, a black toner image is formed on drum 603B, using primary charger 605B, laser 606B and development station 681B, and a cyan toner image is formed on drum 608BC, using primary charger 605C, laser 606C and development station 681C. The black toner image is electrostatically transferred in the nip 610B from drum 603B to the drum 608BC such that the black toner image is transferred on top of the cyan image, thereby forming a registered first composite image. Rotary motion of drum 608BC brings the first composite image into the nip 610BC where the first composite image is electrostatically transferred to a receiver sheet, such as for example the paper sheet 512*b*". In module 691MY, a magenta toner image created on DSPIFM 603M and a yellow toner image created on photoconductive DSITM 608MY are similarly combined in nip 610M to form a second composite image which is transferred on top of the first composite image in nip 610MY to create a registered four-color composite toner image on the receiver sheet.

Prior to forming single-color toner images on drums 603B, 608BC, 603M and 608MY, the outer surfaces of the respective OSMs are cleaned by the respective cleaning stations 604B, C, M, and Y.

In the three embodiments of FIGS. 10, 11 and 12, the transfer backing rollers 521, 521' and 621BC have a preferred diameter of 20–80 mm, preferably running in a constant current mode. The diameters of the DSPIFM and DSITM members are preferably in the range of 80–240 mm. Also, in the three machine embodiments of FIGS. 10, 11 and 12, different receiver sheets may be located in different nips simultaneously and at a times one receiver sheet may be located in two adjacent nips simultaneously, it being appreciated that the timing of image creation and respective transfers to the receiver sheet is such that proper transfer of images are made so that respective images are transferred in register and as expected.

Each of the three embodiments of FIGS. 10, 11 and 12 is provided with a paper transport web in order to move a receiver sheet through nips wherein toner images are transferred to the receiver sheet, as described above. However, in certain applications it may be useful to transfer a toner image from a double-sleeved ITM to a receiver by employing an electrically biased transfer roller directly behind the receiver sheet, i.e., in a nip formed between the double-sleeved ITM and the transfer roller, without the use of a paper transport web. Similarly, it may be useful to transfer a toner image directly from a double-sleeved PIFM to a receiver by employing an electrically biased transfer roller directly behind the receiver sheet, i.e., in a nip formed between the double-sleeved PIFM and the transfer roller, without the use of a paper transport web.

Although it is preferred to be a drum, an ITM in the form of a web may be used with a DSPIFM in the color reproduction apparatus described herein. Similarly, a PIFM in the form of a web may be used with a DSITM. In some applications it may be useful to employ a DSPIFM with an ITM roller which is not double-sleeved. Similarly, in some applications it may be useful to employ a DSITM with a PIFM roller, which is not double-sleeved.

In the color reproduction apparatus described herein, the apparatus may also be used to form color images in various combinations of color in lieu of the four-color image described. Fewer color modules may be provided in the apparatus or additional color modules may be provided in the apparatus. While the description herein is directed to formation of a composite resultant image on a receiver sheet formed of plural color images, the invention contemplates that images of different physical types of toner may be combined on a receiver sheet to form a composite resultant image. Thus, a black toner image may be transferred to a receiver sheet wherein the toner image is formed of non-magnetic toner and a second black image formed on the same receiver sheet using a magnetic toner using the transfer apparatus and methods described herein.

In the described embodiments, the wrap of the belt that supports the receiver member in contact with the TIBM is defined by tension in the transport belt. The actual transfer nip where the major portion of the electrical field exists between the TIBM and the transfer backing roller or other counter electrode for transfer of the toner image to the receiver member is smaller than this wrap. Thus, by providing a greater amount of wrap length than the length of the actual transfer nip there is reduced the likelihood of pre-nip transfer and pre-nip ionization particularly where the transport belt is substantially insulative. As noted above, it is preferred to have the wrap be greater than 1 mm beyond the roller nip in at least the pre-nip area. Where a transfer backing pressure roller is used to apply the pressure to the underside of the belt to urge the receiver member into intimate contact with the TIBM at the nip, it is preferred that the pressure roller be of intermediate conductivity, i.e., bulk resistivity of $10^7$–$10^{11}$ ohm-cm; however, transfer backing rollers that are highly conductive, i.e., having conductivity of a metal, also may be used. Other structures, as noted above, in lieu of transfer backing rollers may be used to apply pressure to the web at the nip including members having conductive fibers that are electrically biased and provided with stiffener structure on either side of the brush for applying pressure to the web, or rollers with conductive fibers.

In the embodiments described above, transfer of the toner image to the DSITM and from the DSITM to the receiver member and generally all toner image transfers are made electrostatically and preferably without addition of heat that would cause the toner to soften. Thus, preferably no fusing occurs upon transfer of the toner images to the receiver member in the nips through which the paper transport belt and receiver member passes. In the forming of plural color images in registration on a receiver sheet, the invention contemplates that plural color toner images may be formed on the same image frame of the photoconductive image member using well known techniques; see, for example Gundlach, U.S. Pat. No. 4,078,929. The primary image-forming member may form images by using photoconductive elements as described or dielectric elements using electrographic recording. The toners used for development are preferably dry toners that are preferably nonmagnetic and the development stations are known as two-component development stations. Single component developers may be used, but are not preferred. While not preferred, liquid toners may also be used.

Other charging means such as rollers may be used instead of the corona wire chargers used for electrostatically holding the receiver member or print media to the web ("tacking") and also for electrically discharging the receiver member.

Cleaning of the front side and back side of the PTW belt may be provided by wiper blades 560 and 562 (FIG. 10), 560', 562' (FIG. 11), or 560", 562" (FIG. 12), respectively. It is preferred to use wiper blades for both of the front and backside cleaning.

Additional thin coating layers (not indicated in any of the figures) for promoting inter-layer adhesion may be employed in the fabrication of ISM and OSM members, such as for example priming or subbing layers well known in the art may be used.

In order to promote placement or removal of an ISM or OSM of the invention, sub-micron particles of silica, titania and the like may be applied to the outer surface of a core member, to an inner or outer surface of an ISM, or to the inner surface of an OSM. Alternatively, a surface region having a thickness of the order of a few molecular dimensions and chemically selected or modified to comprise chemical molecular groups exhibiting a low surface energy may be provided on these surfaces (not indicated in any of the figures).

The invention discloses a double-sleeved roller (DSR) for use in an electrostatographic machine, the DSR including a substantially cylindrical substantially rigid core member, a replaceable removable multilayer inner sleeve member (ISM) in the shape of an endless tubular belt including at least one compliant layer such that the ISM surrounds and nonadhesively intimately contacts the core member, and a replaceable removable multilayer outer sleeve member (OSM) in the shape of an endless tubular belt including at least one synthetic layer such that the OSM surrounds and nonadhesively intimately contacts the ISM. The synthetic layer may comprise, for example, a plastic, a polymer, a copolymer, an elastomer, a foam, a photoconductive material, a material including filler particles, a material including two or more phases, or a material reinforced with fibers. The ISM is placeable on the core member by a sleeve placement method and the OSM is placeable on the ISM by a sleeve placement method, the OSM being removable from the ISM by a sleeve removal method and the ISM being removable from the core member by a sleeve removal method, any of the sleeve members retaining a form of an endless belt not only during operation of the double-sleeved roller, but also during placement of any sleeve member or during removal of any sleeve member. In the preferred embodiments, the DSR may be a DSPIFM, a DSITM, or a bifunctional photoconductive DSITM.

A preferred sleeve placement method includes providing a source of a pressurized fluid to the underside of a sleeve member, the preferred pressurized fluid being compressed air; turning on the source of the pressurized fluid to elastically expand the sleeve member so as to allow the sleeve member to be moved along the surface of a substrate including another member in order to surround the other member, the other member being a core member or an inner sleeve member mounted on a core member; continuing to keep open the source of pressurized fluid while sliding the sleeve member to be moved until it reaches a predetermined position surrounding the other member; shutting off the source of the pressurized fluid, thereby allowing the sleeve member to relax and grip the said another member under tension. Other methods of sleeve placement may be used, including heating the sleeve member being placed on a substrate, or cooling the substrate in order to take temporary advantage of dimensional changes produced by the heating or cooling.

A preferred sleeve removal method includes providing a source of a pressurized fluid to the underside of a sleeve member, the preferred pressurized fluid being compressed air, turning on the source of the pressurized fluid to elastically expand the sleeve member so as to allow the sleeve member to be moved along the surface of a substrate including another member that it surrounds, the other member being a core member or an inner sleeve member mounted on a core member; continuing to keep open the source of pressurized fluid while sliding the sleeve member and removing it from the other member; shutting off the source of the pressurized fluid. Other methods of sleeve removal may be used, including heating the sleeve member being removed from a substrate, or cooling the substrate in order to take temporary advantage of dimensional changes produced by the heating or cooling.

Turning now to preferred embodiments including sleeve members of the invention, FIG. 1 shows a cross-sectional view, indicated by the numeral 10, of a preferred embodiment of an inner sleeve member identified by the numeral 15 which is mounted on a cylindrical rigid core member identified by the numeral 11. The ISM is preferably in the form of an endless tubular belt and may be employed in a double-sleeved roller including a compliant or a photoconductive OSM. The preferred core member 11 is substantially rigid and is generally not solid throughout, and as shown in FIG. 1 preferably includes a hollow cylindrical metal tube or shell made for example from aluminum. Core member 11 has a smooth surface, and preferably has a runout of less than 80 micrometers and more preferably less than 20 micrometers. Core member 11 may have interior structures which may include chambers, e.g., for compressed air and associated piping, strengthening struts, and the like, and may be provided with holes for carrying compressed air from an interior chamber through its cylindrical shell during placement or removal of the inner sleeve member 15.

Inner sleeve member 15 includes a strengthening band 12, an inner sleeve compliant layer (ISCL) 13 coated on the strengthening band, and a protective layer 14 coated on the ISCL. The strengthening band (SB) 12 may be rigid or flexible, has a Young's modulus preferably less than 300 GPa, and a thickness preferably in a range 1–500 micrometers and more preferably in a range 5–150 micrometers. An SB can be comprised of any suitable material, including metal, elastomer, a copolymer, a plastic or other material, a fabric, or a reinforced material including a filler or fibers such as, for example, a reinforced silicone belt. An SB may be provided with a high surface energy on its outer surface prior to forming the ISCL layer on it, and may also be provided with a low energy inner surface which is in contact with the core member. It is preferred that the SB is an endless web or tubular belt, which for example may be woven, extruded, electroformed, or fabricated from a sheet by using, for example, ultrasonic welding or an adhesive. More preferably, the SB is seamless.

The ISCL 13 preferably has a thickness in a range 5–20 mm and more preferably 2–10 mm, and a Young's modulus preferably less than about 10 MPa and more preferably in a range 1–5 MPa. The ISCL 13 is preferably formed of a polymeric material, e.g., an elastomer such as a polyurethane or other materials well noted in the published literature. The ISCL 13 may comprise a material having one or more phases, e.g., a foam or a dispersion of one solid phase in another. Preferably, the ISCL has a Poisson's ratio in a range 0.2–0.5, and more preferably the ISCL has a Poisson's ratio in a range 0.45–0.5, and a preferred material is a polyurethane with a Poisson's ratio of about 0.495.

The protective layer 14 is preferably made from any suitable material which is flexible and hard, e.g., a synthetic material, preferably a ceramer or a sol-gel, applied to the thick compliant layer 13 by any suitable coating method. Alternatively, the protective layer 14 may comprise a thin metal band, e.g., nickel, which may be adhered to the ISCL 13 or which may be in the form of an endless belt under tension applied to the outer surface of the ISCL 13 by, for example, using compressed air assist, or by cooling the SB plus its ISCL coating in order to shrink it so as to slide on the endless metal belt. The protective layer 14 has a thickness preferably in a range 1–50 micrometers and more preferably in a range 1–50 micrometers, and a Young's modulus preferably greater than 100 MPa and more preferably in a range 0.5–20 GPa.

In FIG. 2 is shown a cross-sectional view of a preferred embodiment of a compliant outer sleeve member which is identified by the numeral 20, and which may be used in a DSITM. The OSM 20 is preferably an endless tubular belt and includes a stiffening layer 21, an outer sleeve compliant layer (OSCL) 22 coated on the SL 21, and a release layer 23 coated on the thin OSCL 22. The stiffening layer 21 preferably has the form of a seamless endless belt and preferably includes any suitable metal, e.g., steel, nickel, or other high tensile metal. Alternatively, SL 21 may comprise an elastomer such as for example a polyurethane, a polyimide, a polyamide or a fluoropolymer, the elastomer having a yield strength which is not exceeded during use. The SL 21 may also comprise a fabric or a reinforced material, or it may comprise a sol-gel or a ceramer having a yield strength which is not exceeded during use. Preferably, SL 21 is made of nickel, e.g., in the form of a suitably thin electroformed seamless nickel belt available for example from Stork Screens America, Inc., of Charlotte, N.C. A stiffening layer 21 preferably has a thickness less than about 500 micrometers and more preferably in a range 10–200 ricrometers. The stiffening layer 21 also has a Young's modulus preferably greater than about 0.1 GPa and more preferably in a range 50–300 GPa. The SL 21 preferably has a bulk or volume electrical resistivity of less than about $10^{10}$ ohm-cm, and is also preferably connectable to a source of electric voltage or current. However, in some applications it may be desirable to use a non-conductive material for the SL 21, in which case SL 21 may be coated with a thin conductive material, e.g., a metallic film applied to its surface which is connectable to a source of electric voltage or current.

The OSCL 22 has a thickness in a range 0.5–2 mm, and preferably has a Young's modulus less than about 10 MPa and more preferably in a range 1–5 MPa. The OSCL 22 is preferably formed of a polymeric material, e.g., an elastomer such as a polyurethane or other materials well noted in the published literature, and may comprise a material having one or more phases, e.g., a foam or a dispersion of one solid phase in another. Preferably, the OSCL 22 has a Poisson's ratio in a range 0.2–0.5, and more preferably the OSCL has a Poisson's ratio in a range 0.45–0.5, and a preferred material is a polyurethane with a Poisson's ratio of about 0.495. In order to provide a suitable resistivity, the elastomer including the OSCL 22 may be doped with sufficient conductive material (such as antistatic particles, ionic conducting materials, or electrically conducting dopants) to have a relatively low resistivity. The OSCL 22 should have a bulk electrical resistivity preferably in a range $10^7$–$10^{11}$ ohm-cm, and more preferably about $10^9$ ohm-cm. The release layer 23 preferably includes a synthetic material such as a sol-gel, a ceramer, a polyurethane or a fluoropolymer, but other materials having good release properties including low surface energy materials may also be used. The release layer 23 preferably has a Young's modulus greater than 100 MPa, more preferably 0.5–20 GPa, and a thickness preferably in a range of 1–50 micrometers and more preferably in a range 4–15 micrometers. The release layer 23 has a bulk electrical resistivity preferably in a range $10^7$–$10^{13}$ ohm-cm and more preferably about $10^{10}$ ohm-cm.

FIG. 3 illustrates a photoconductive outer sleeve member identified as 30, which is useful for a DSPIFM drum. OSM 30 is preferably an endless tubular belt and includes a stiffening layer 31 and a photoconductive structure 32 coated on the SL. The photoconductive structure 32, may include one or more layers which may comprise any known suitable photoconductive material, such as for example, an inorganic material or dispersion, a homogeneous organic photoconductive layer, an aggregated organic photoconductive layer, a composite structure including a charge generating layer (CGL) plus a charge transport layer (CTL), and the like. The SL 31 is preferably suitably conductive with a bulk or volume electrical resistivity of less than about $10^{10}$ ohm-cm, and connectable to ground potential. However, in some applications it may be desirable to use a non-conductive material for the stiffening layer, in which case SL 31 may be coated with a thin conductive material, e.g., a metallic film, applied its surface, which is connectable to ground potential. The stiffening layer 31 may comprise any suitably strong flexible material and has a thickness preferably less than about 500 micrometers and more preferably in a range 10–200 micrometers. The stiffening layer also has a Young's modulus preferably greater than about 0.1 GPa and more preferably in a range 50–300 GPa. The SL is preferably in the form of a seamless tubular belt.

FIG. 4(*a*) shows a preferred embodiment of a photoconductive OSM as indicated by a composite structure 40A, which includes a stiffening layer 41, a barrier layer 42 coated on the SL, a CGL 43 coated on the barrier layer, and a CTL 44 coated on the CGL. OSM 40A is preferably an endless tubular belt. The stiffening layer 41 is preferably in the form of a seamless tubular belt and may comprise any suitably strong flexible material. The stiffening layer 41 has a thickness of less than 500 micrometers and preferably in a range 10–200 micrometers, and a Young's modulus greater than 0.1 GPa and preferably in a range 50–300 GPa. More preferably the SL 41 is an electroformed seamless nickel belt about 0.005 inch (127 micrometers) thick available, e.g., from Stork Screens America, Inc., of Charlotte, N.C. The barrier layer 42 includes any suitable material such as for example a nylon that prevents charge injection from the SL 41, and the barrier layer preferably includes a polyamide resin layer 0.5–1.0 micrometers thick coated on SL 41. The CGL 43 may be comprised of any suitable materials, including dispersions, such as are well known in the literature. Preferably, CGL 43 is of the type described by Molaire et al. in U.S. Pat. No. 5,614,342 and includes a co-crystal dispersion coated on the barrier layer, the CGL having a thickness in a range 0.5–1.0 micrometer and preferably about 0.5 micrometer. The CTL 44, coated on the CGL 43, has thickness in a range 12–35 micrometers and is preferably about 25 micrometers thick. CTL 44 may comprise any suitable compositions and materials such as are well known in the published literature, and preferably includes 2 parts by weight of tri-tolylamine and 2 parts by weight 1,1-bis{4-(di-4-tolylamino)phenyl}methane in a binder consisting of 1 part by weight poly[4,4'-(2-norbornylidene)bisphenol terephthalateco-azelate-(60/40)] and 5 parts by weight Makrolon™ polycarbonate obtainable from the General Electric Company, Schenectady, N.Y., as referred to in U.S. Pat. No. 5,614,342.

Figure 4B:
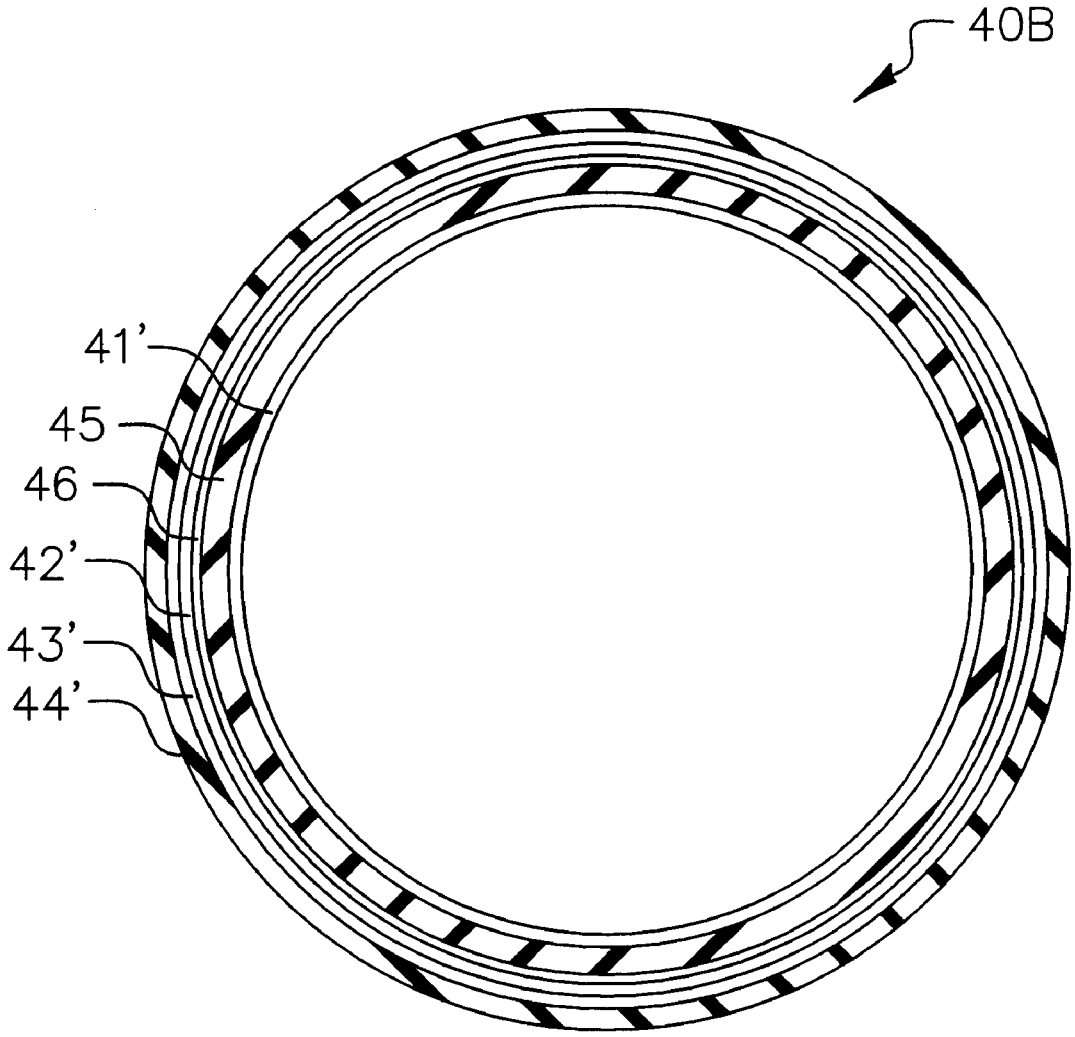

FIG. 4(*b*) shows a more preferred embodiment of a photoconductive OSM, indicated by a composite multilayer structure 40B that has additional layers as compared to 40A of FIG. 4(*a*). Except for the additional layers, some layers of this more preferred embodiment directly correspond with layers 41, 42, 43, and 44 of OSM 40A, and the layers which correspond in properties and dimensions to these layers are identified as 41', 42', 43' and 44' in FIG. 4(B). OSM 40B includes a stiffening layer 41' preferably having the form of a seamless tubular belt, a compliant layer 45 formed on the stiffening layer, an optional electrode layer 46 coated on layer 45, an optional barrier layer 42' coated on electrode layer 46, a CGL 43' coated on the barrier layer, and a CTL 44' coated on the CGL. The optional barrier layer 42' may be required to suppress unwanted charge injection, either from the compliant layer 45 into the charge-generating layer or from the optional electrode layer 46 into the charge generating layer. OSM 40B is preferably a seamless endless belt. Apart from the previously specified resistivity for layer 41, which is not required for layer 41' which may have any resistivity, the layers 41', 42', 43' and 44' are to all extents and purposes similar to layers 41, 42, 43, and 44 respectively, and so are not described further here. The optional electrode layer 46 includes any thin conductive flexible material, such as for example nickel, and is connectable to ground potential. With the exception of the requirement of a specified resistivity, the compliant layer 45 is otherwise in all respects of properties and dimensions similar to layer 22 of the compliant OSM 20 of FIG. 2. An advantage of OSM 40B over OSM 40A is the microcompliance provided by the compliant layer 45.

In another alternative modification of embodiment 40B, the compliant layer 45 has a resistivity preferably less than about $10^{10}$ ohm-cm and electrode layer 46 is omitted, requiring that the SL 41' be connectable to ground potential and have a bulk resistivity similar to that of layer 41, or else if SL 41' is insulative it is required to be coated with a thin flexible conductive layer connectable to ground potential.

Preferred mechanisms and methods for placing sleeve members on a double-sleeved roller and for removing sleeve members from a double-sleeved roller (DSR) are illustrated in FIGS. 5–9.

Figure 5:
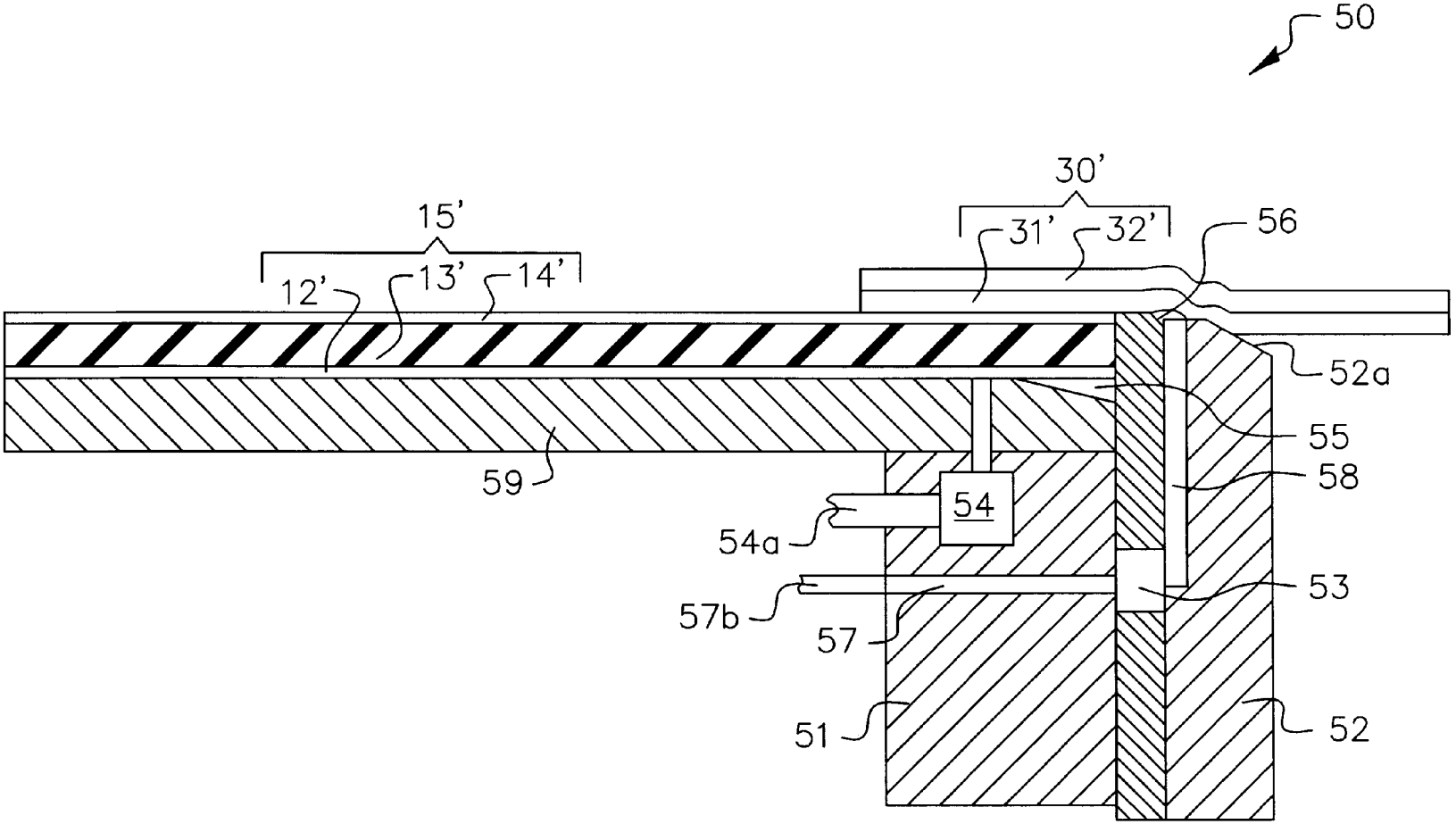
FIG. 5 illustrates a cross-sectional partial view of a preferred embodiment of a double-sleeved primary image-forming member roller, schematically showing an outer imaging sleeve being moved on or off an inner compliant sleeve using compressed air assist, the inner compliant sleeve already in place on a rigid cylindrical core member.

FIG. 5 shows a partial cutaway view of a preferred embodiment of a DSR with its outer sleeve member being placed on, or removed from, an inner sleeve member. During operation for producing prints the double-sleeved roller is supported at both axial ends. However, when a sleeve is to be removed, the support at one end is moved away and the DSR is supported at an opposite end (not shown) from which a sleeve member is placed or removed, and remains connected to a frame member of an electrostatographic machine during placement or removal of a sleeve. It should be understood that FIG. 5, may generally represent any double-sleeved roller of the invention. For exemplary purposes, the DSR is shown as a DSPIFM indicated by the numeral 50. Some of the numbered sleeve components in FIG. 5 correspond to members previously described above, and are indicated by correspondingly primed numerals. An inner sleeve member 15' is shown in an installed position on a portion of a core member 59. Inner sleeve 15' includes a strengthening band 12' in intimate nonadhesive contact with core member 59, an inner sleeve compliant layer 13' coated on SB 12', and a hard protective layer 14' coated on the inner sleeve compliant layer 13'. An outer sleeve member 30' is depicted in the process of being placed on, or removed from, the inner sleeve member 15'. For present purposes the outer sleeve 30' includes a stiffening layer 31' and a photoconductive structure 32' coated on SL 31'. Placement or removal of outer sleeve 30' is facilitated by flowing a fluid under pressure through the hollow 57*a* of the core, from for example a source of compressed fluid which is preferably compressed air flowing through a pipe 57*b*, then through a connecting duct 57 passing through an endblock 51 and connecting to a pipe 58 inside an endcap or gudgeon member 52 which mates to endblock 51. Pipe 58 is one of a plurality of similar pipes radiating from a common manifold 53. All of these pipes (others not shown) pass to the surface of the endcap member 52 in order to supply compressed air to a corresponding plurality of holes that terminate the plurality of pipes at the periphery of endcap 52. Compressed air emerging from the plurality of holes underneath OSM 30' causes it to elastically expand, thereby allowing sleeve 30' to be moved or slid along the surface of ISM 15'. Endcap 52 includes an annular tapered portion 52*a* to aid in starting the placement of OSM 30'. Endcap 52 also includes an annular bevel 56, which has been found to be beneficial in helping to get sleeve 30' on or off. Now assume that sleeve 30' is being removed. Once sleeve 30' has been removed, the source of compressed air passing through tube 57 is shut off. In order to remove ISM 15', endcap 52 is first removed. Then, as shown in FIG. 5, compressed air is made to flow through another pipe 54*a* which enters a manifold 54 inside endblock 51, which in turn leads to a plurality of pipes which pass radially through the end of core member 59 and terminate in a corresponding plurality of holes on the periphery of core member 59. Compressed air emerging from this plurality of holes expands ISM 15', thereby allowing it to be slid off the core member 59, and after removal of sleeve 15', the source of compressed air is shut off. In order to replace an inner and an outer sleeve on a bare core member 59, the steps of the above process are reversed. In placing ISM 15', an annular bevel 55 formed at the end of the core member has been found to be a useful aid.

Figure 6:
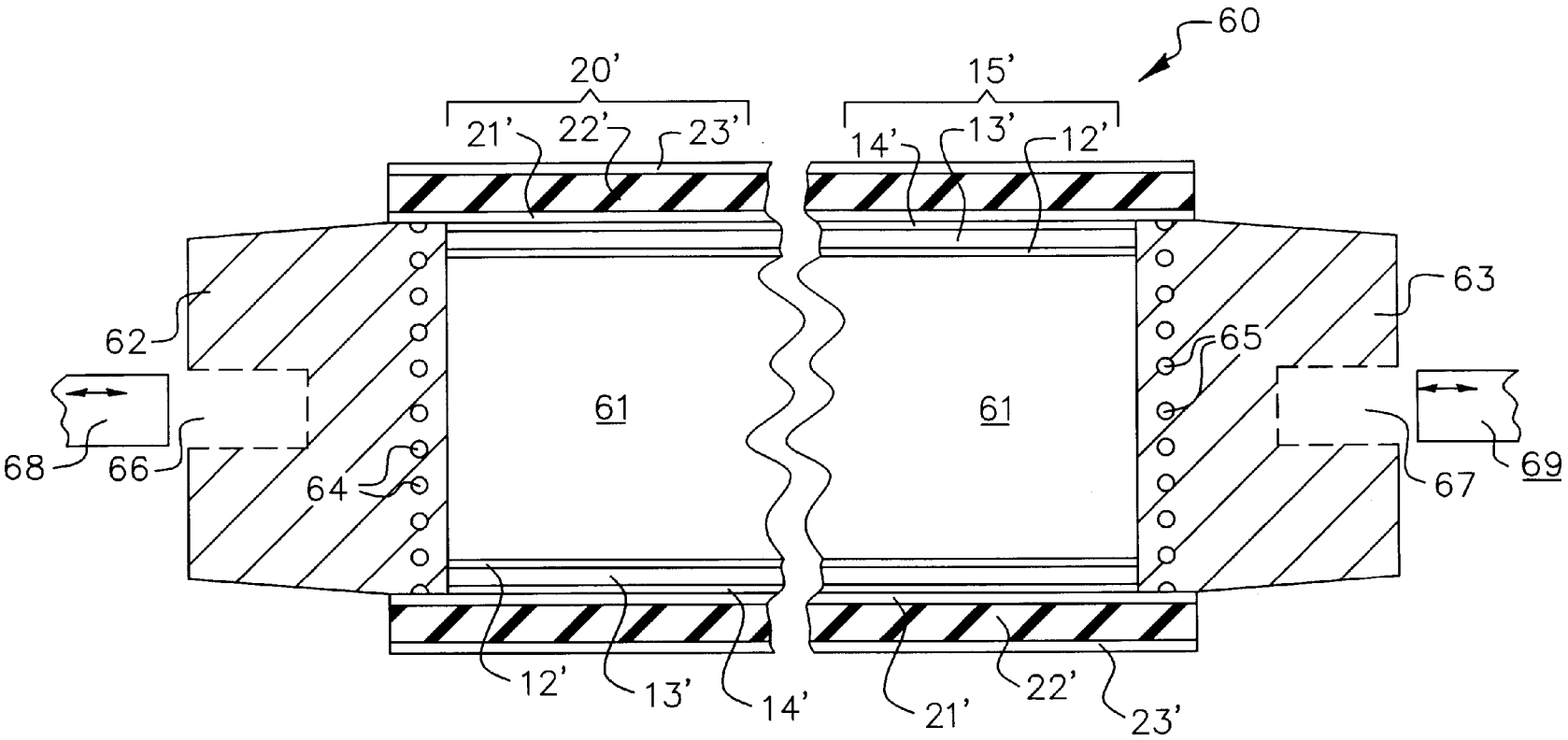
FIG. 6 illustrates a cross-sectional view of a preferred embodiment of an assembled double-sleeved intermediate transfer member roller including a rigid cylindrical core member, first and second removable tapered members respectively attached to each end of the core member, a compliant inner sleeve member in intimate contact with the core member and overlapping a cylindrical portion of the first removable tapered member containing openings for admission of compressed air, and an outer compliant sleeve member in intimate contact with the inner sleeve member and overlapping a cylindrical portion of the second removable tapered member containing openings for admission of compressed air.

FIG. 6 shows a partial cutaway view of another preferred embodiment of a DSR generally representing any double-sleeved roller of the invention. For exemplary purposes, the DSR is shown as a DSITM indicated by the numeral 60, although the DSR may also be a DSPIFM. Some of the numbered sleeve components in FIG. 6 correspond to members previously described above, and are indicated by correspondingly primed numerals. DSITM 60 includes a core member 61 (no internal details of core 61 are depicted), an ISM 15' in intimate nonadhesive contact with core 61, and a compliant OSM 20' in intimate nonadhesive contact with ISM 15'. Inner sleeve 15' includes a strengthening band 12' in intimate nonadhesive contact with core member 61, a compliant layer 13' coated on SB 12', and a hard protective layer 14' coated on the compliant layer 13'. The outer sleeve member 20' includes a stiffening layer 21', a compliant layer 22', and a release layer 23', but it is to be understood that member 20' may also represent a photoconductive OSM of a DSPIFM. Also illustrated are two tapered removable endpieces or gudgeons, namely, a larger diameter endpiece 62 at one end of the roller 60, and a smaller diameter endpiece 63 at the other end of the roller. Depressions 66 and 67 are shown in endpieces 62 and 62, respectively, into which axle members 68 and 69 respectively can fit.

The axle members 68 and 69 are attached to frame members of an electrostatographic machine, and during operation of DSITM 60, each axle member is embedded into its corresponding depression, thereby supporting the roller. As indicated by the double-ended arrows shown on each of the axle members, each axle member may be independently moved in or out of its corresponding depression as required, when placing or removing a sleeve. DSITM 60 is always supported at one end or the other during a sleeve removal or replacement. Thus, axle member 68 is removed from depression 66 when OSM 20' is to be removed or replaced, with axle 69 remaining within depression 67 as a support. Similarly, axle member 69 is removed from depression 67 when ISM 15' is to be removed or replaced, with axle 68 remaining within depression 66 as a support. It is to be understood that the present depictions of axle members 68 and 69 and depressions 66 and 67 are exemplary only, and that any suitable means of separably supporting the roller at either end of the roller may be used.

OSM 20' overlaps a plurality of holes passing through a cylindrical portion of endpiece 62, the cylindrical portion having an outer diameter which is substantially the same as the sum of the outer diameter of core member 61 plus the thickness of ISM 15'. The plurality of holes is connected to a source of compressed air which is used to expand sleeve 20' during its removal from, or placement on, the ISM 15'. Similarly, ISM 15' overlaps a plurality of holes passing through a cylindrical portion of endpiece 63, the cylindrical portion having an outer diameter which is substantially the same as the outer diameter of core member 61. The plurality of holes is connected to a source of compressed air which is used to expand sleeve 15' during its removal from, or placement on, the core member 61, OSM 20' not being present during removal or placement of ISM 15'.

Figure 7:
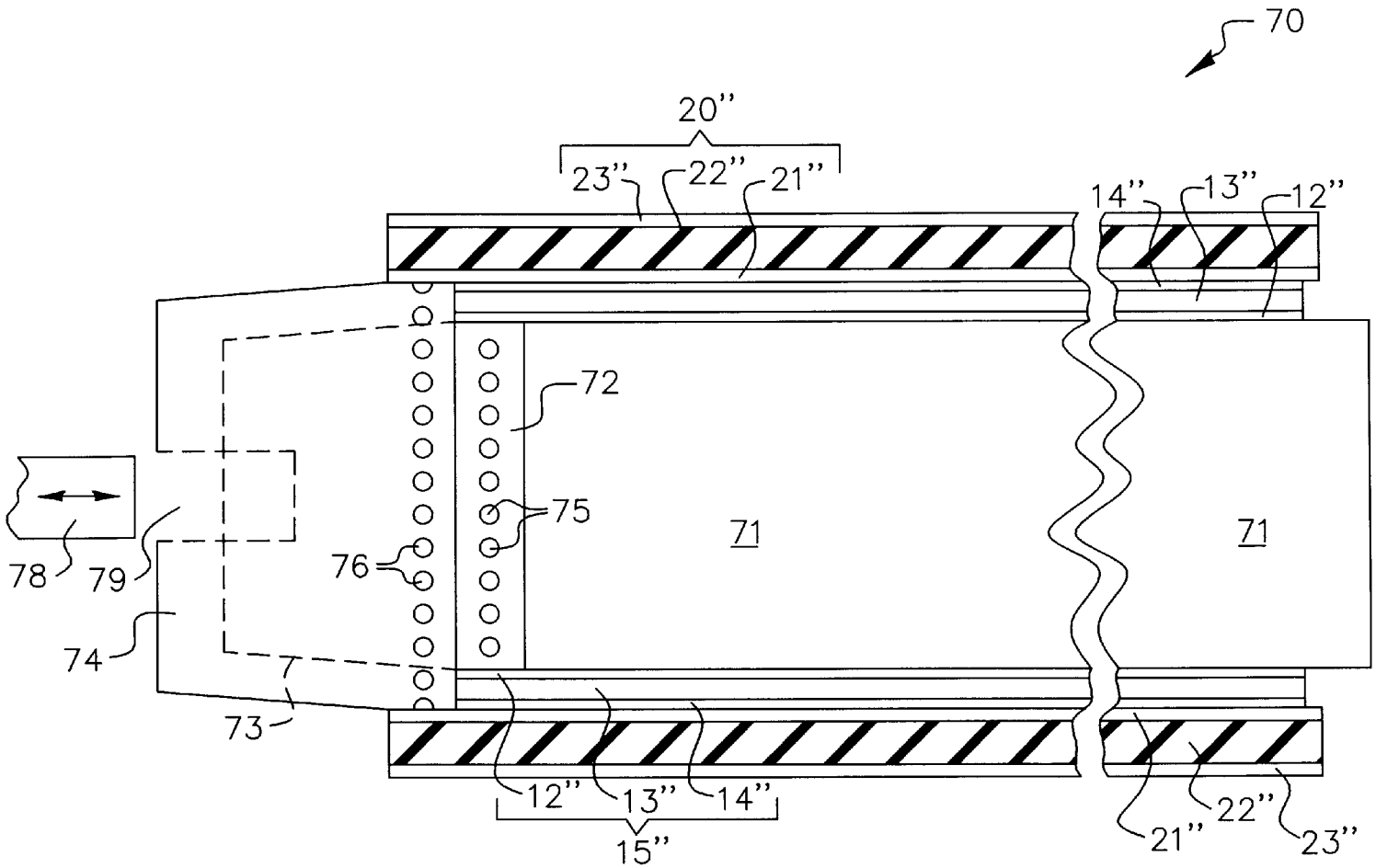
FIG. 7 illustrates a cross-sectional view of one end of a preferred embodiment of an assembled double-sleeved intermediate transfer member roller including a rigid cylindrical core member, a removable cylindrical member containing openings for admission of compressed air and attached to an end of the core member, a compliant inner sleeve member in intimate contact with the core member and overlapping the openings of the removable cylindrical member, a first removable tapered member attached to the removable cylindrical member, and an outer compliant sleeve member in intimate contact with the inner sleeve member and overlapping a cylindrical portion of the first removable tapered member containing openings for admission of compressed air. The dashed lines represent a second, smaller tapered member, not present in the assembled ITM, which attaches to the removable cylindrical member to aid in installing or removing the inner sleeve when the first tapered member and the outer sleeve are not present.
Figure 8A:
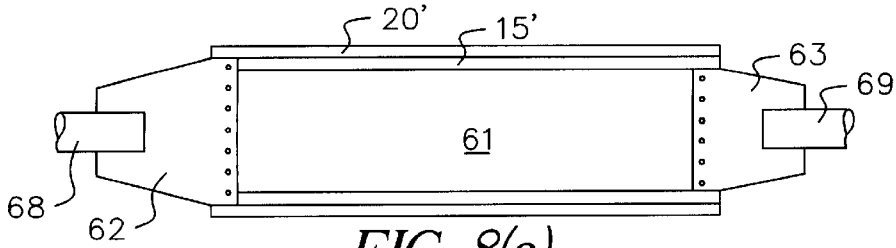
FIGS. 8(*a*) to (*d*) illustrate schematically steps of disassembly of the double-sleeved roller of FIG. 6, using the same reference numbers for similar parts as in previous figures: (a) disconnection of a support axle from one end of the roller, the roller remaining supported at the other end still attached to a frame portion; (b) removal of the outer sleeve member using compressed air assist at the unsupported end of the roller; (c) reconnection of the removed support axle and disconnection of the support axle from the other end of the roller, the roller remaining supported at the other by the reconnected support axle attached to another frame portion; (d) removal of the inner sleeve member using compressed air assist at the unsupported end of the roller.
Figure 8B:
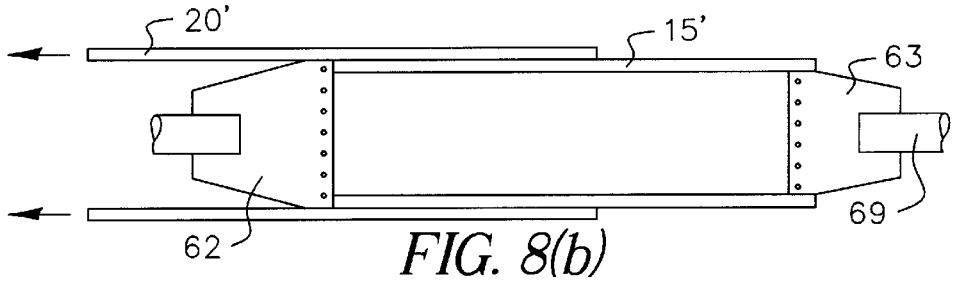
Figure 8C:
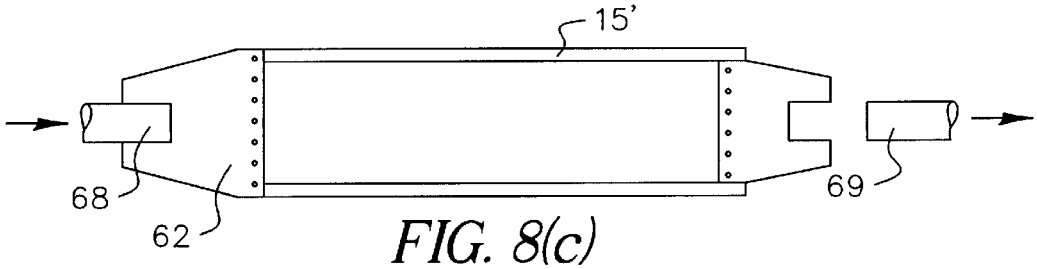
Figure 8D:
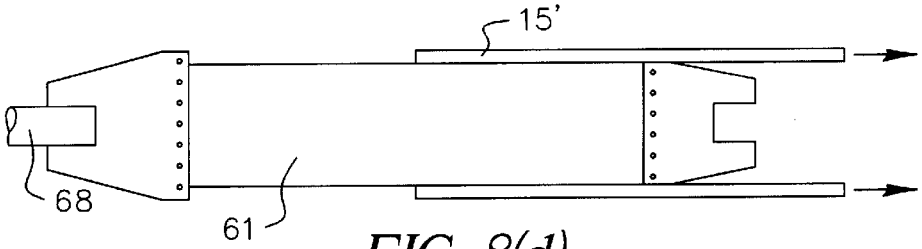
Figure 9A:
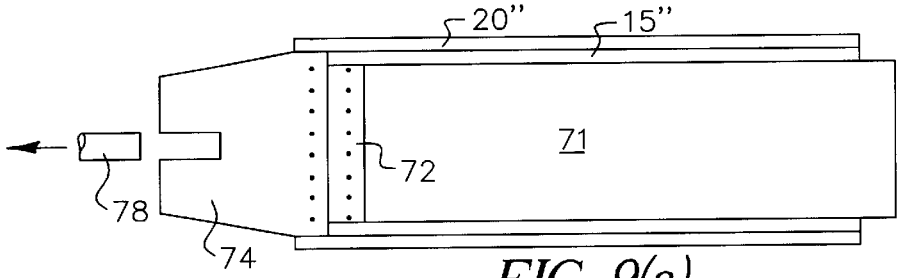
FIGS. 9(*a*) to (*d*) illustrate schematically steps of disassembly of the double-sleeved roller of FIG. 7, using the same reference numbers for similar parts as in previous figures: (a) disconnection of a support axle from one end of the roller, the roller remaining supported at its other end still attached to a frame portion; (b) removal of the outer sleeve member using compressed air assist at the unsupported end of the roller; (c) after disconnection and removal of a larger tapered member from the unsupported end of the roller (this step not illustrated), attachment of a smaller diameter tapered member in its stead, the roller remaining supported at its other end; (d) removal of the inner sleeve member using compressed air assist at the unsupported end of the roller.
Figure 9B:
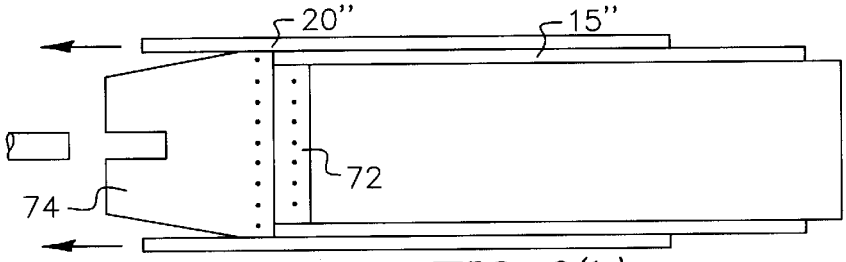
Figure 9C:
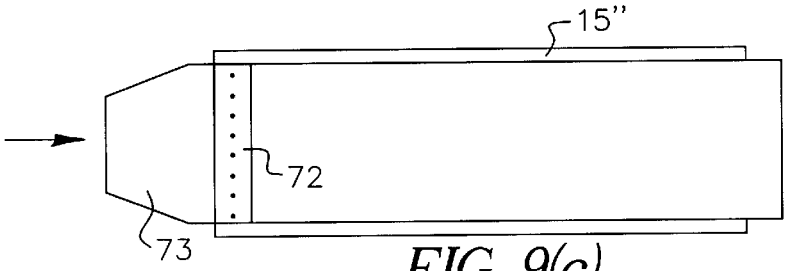
Figure 9D:
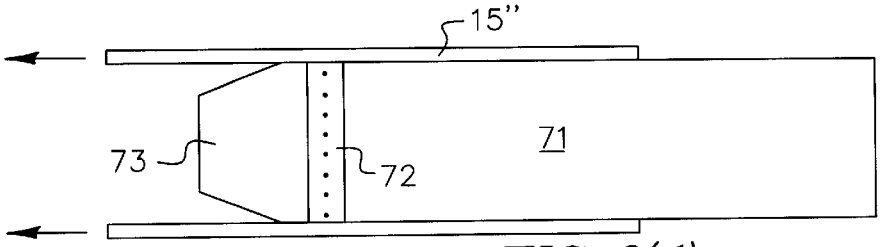

FIG. 7 shows a partial cutaway view of yet another preferred embodiment of a DSR generally representing any double-sleeved roller of the invention. For exemplary purposes, the DSR is shown as a DSITM indicated by the numeral 70, although the DSR may also be a DSPIFM. Some of the numbered sleeve components in FIG. 7 correspond to members previously described above, and are indicated by correspondingly double-primed numerals. DSITM 70 includes a core member 71 (no internal details of core 71 are depicted), an ISM 15" in intimate nonadhesive contact with core 71, and a compliant OSM 20' in intimate nonadhesive contact with ISM 15". Also shown is a disc shaped end member 72, which is permanently attached to one end of core member 71, with member 72 having substantially the same outer diameter as core member 71. Inner sleeve 15" includes a strengthening band 12" in intimate nonadhesive contact with core member 71, an inner sleeve compliant layer (ISCL) 13" coated on SB 12", and a hard protective layer 14" coated on the ISCL 13". The outer sleeve member 20" includes a stiffening layer 21", a compliant layer 22", and a release layer 23", but it is to be understood that member 20" may also represent a photoconductive OSM of a DSPIFM.

Also illustrated is a removable tapered endpiece or gudgeon 74, fitted with a depression 79, into which axle member 78 can fit. The axle member 79 is attached to a frame member of an electrostatographic machine, and during operation of DSITM 70 is embedded into depression 79, thereby supporting the roller in conjunction with a permanent axle at the other end of the roller (not shown). DSITM 70 is always supported by this permanent axle during a sleeve removal or replacement. As indicated by the double-ended arrow, axle member 78 is moved out of depression 79 when placing or removing either of the sleeves. It is to be understood that the present depiction of axle member 78 and depression 79 is exemplary only, and that any suitable means of separably supporting the roller at the end of the roller opposite to the end with the permanent axle may be used. OSM 20" overlaps a plurality of holes passing through a cylindrical portion of tapered endpiece 72, the cylindrical portion having an outer diameter which is substantially the same as the sum of the outer diameter of core member 71 plus the thickness of ISM 15". The plurality of holes is connected to a source of compressed air which is used to expand sleeve 20" during its removal from, or placement on, the ISM 15". With OSM 20" removed, and after removing tapered endpiece 74, a smaller diameter disc shaped member 73, shown in dash-dot outline, is attached to member 72. ISM 15" overlaps a plurality of holes passing through a disc shaped end member. The plurality of holes is connected to a source of compressed air which is used to expand sleeve 15" during its removal from, or placement on, the core member 71, sleeve 15" being moved or slid over the temporary member 73.

FIG. 8 shows schematically how both outer and inner sleeve members are removed from the DSITM 60 shown in FIG. 6. In (a), axle member 68 is removed from tapered member 62; in (b), OSM 20' is slid off and removed from ISM 15' using compressed air assist as described above; in (c), axle member 68 is replaced and axle member 69 is removed; and in (d), ISM 15' is slid off and removed from core member 61 using compressed air assist.

FIG. 9 shows schematically how both outer and inner sleeve members are removed from the DSITM 70 shown in FIG. 7. In (a), axle member 78 is removed from tapered member 74; in (b), OSM 20" is slid off and removed from ISM 15" using compressed air assist as described above, and tapered end member 74 is removed; in (c), smaller diameter tapered end member 73 is attached to member 72; and in (d), ISM 15" is slid off and removed from core member 71 using compressed air assist.

Methods of making an inventive inner sleeve member for a double-sleeved intermediate transfer roller are described below in Steps (1), (2) and (3). These methods are also appropriate for making an inventive inner sleeve member for a double-sleeved primary imaging member roller.

Step (1)

Selection and Preparation of a Strengthening Band Prior to Coating of an Inner Sleeve Member Compliant Layer:

Adhesion between a strengthening band and an inner sleeve compliant layer is critical for the manufacture of an ISM, which involves a harsh grinding process. Good adhesion also ensures that an ISM can be ground to a finish with state-of-art equipment to give a very low run-out. Enhancement of the adhesion of an ISCL including, for example, a polyurethane to a strengthening band made, e.g., of nickel can be done by cleaning well the nickel surface, e.g., by degreasing the nickel by a ketone solvent, or by etching it with a diluted strong acid or base. Roughening the surface may also help in promoting good adhesion. Another method to enhance adhesion is to use for the strengthening band a metal plated metal band, e.g., an electroformed copper plated nickel belt, e.g., from Stork Screens America, Inc., of Charlotte, N.C. In addition to copper, metals such as aluminum or zinc can also be used to cover the nickel surface to enhance adhesion. Alternatively, adhesion can be greatly improved by surface treatment of the nickel to induce chemical bonding between nickel and polyurethane, such as by the use of commercially available urethane primers. Examples of such primers are CONAP® AD6, CONAP® AD1147 obtainable from Conap Inc. of Olean, N.Y., and Chemlok® 210, Chemlok® 213, Chemlok® 218, or Chemlok® 219 obtainable from Lord Corporation, Cary, N.C., to name just a few. Such primers are less desirable since an extra layer (primer layer) between nickel and conductive polyurethane blanket may contaminate and change the resistivity of the ISM. The preferred method is to surface treat a nickel sleeve as in the following example:

EXAMPLE 1

Surface Treatment of Strengthening Band Before Polyurethane Casting

Preclean an electroformed nickel belt purchased from Stork Screens America, Inc., of Charlotte, N.C. with 1N sodium hydroxide solution, followed by rinsing with water, then air dry. Prepare treatment solution: 2 wt % (3-aminopropyltriethoxysilane obtained from Gelest Inc., of Tullytown, Pa.) and 98 wt % (95% ethanol+5% water). Shelf life of the treatment solution is one hour. Dip cleaned nickel belt in treatment solution for 10 minutes. Rinse the nickel belt with ethanol. Cure strengthening band at 150° C. for 30 minutes.

Step (2)

ISCL Blanket Formulation and Preparation:

A polyurethane blanket is formed on a strengthening band in a mold by casting from commercially available prepolymers, polyols, chain extenders and anti-stats. The strengthening band is mounted on a cylindrical metal mandrel to form the inner wall of the mold, and the mandrel is placed at the center of a cylindrical outer wall, the gap between them defining the blanket thickness. U.S. Pat. Nos. 4,729,925 and 5,212,032 teach preparation of resistive polyurethane elastomers based on bis[oxydiethylenebis (polycaprolactone)yl]5-sulfo-1,3-benzenedicarboxylate. In U.S. Pat. No. 4,729,925, a controlled resistivity is provided by including the anti-stat agent methyltriphenylphosphonium sulfate, known by the acronym PIP. In U.S. Pat. No. 5,212,032, a controlled resistivity is provided by including the anti-stat made from a complex of diethylene glycol and ferric chloride, abbreviated below as DGFC. Preferred procedures are given in Examples 2, 3 and 4 below.

EXAMPLE 2

Inner Sleeve Polyurethane Blanket Formulation with PIP anti-stat

Mix together 55.385 grams of PIP anti-stat, 597.58 grams of PPG2000 diol-terminated prepolymer obtained from Dow Chemical Company of Midland, Mich., and 3 drops SAG 47 antifoam agent obtained from Witco Corporation of Greenwich, Conn. Add 2820.66 grams preheated LA 2 diisocyanate-terminated prepolymer obtained from Uniroyal Chemical Company of Middlebury, Conn., and 126.38 grams EC300 diamine obtained from Albemarle Corporation of Baton Rouge, L.A. (no heat). Optionally, add if necessary three drops of dibutyltin dilaurate (obtained from Aldrich Chemical Company of Milwaukee, Wiss.). Mix well quickly and degas the mixture for five minutes. Pour the mixture into a mold containing a pre-treated strengthening band mounted on a mandrel as described above, and cure at 80° C. for 18 hours.

EXAMPLE 3

Inner Sleeve Polyurethane blanket Formulation with DGFC Anti-stat

Mix together 0.364 grams DGFC anti-stat, 52.83 grams PPG2000 diol-terminated prepolymer obtained from Dow Chemical Company of Midland, Mich., and 3 drops SAG 47 antifoam agent obtained from Witco Corporation of Greenwich, Conn. Add 52.83 grams preheated L42 diisocyanate-terminated prepolymer obtained from Uniroyal Chemical Company of Middlebury, Conn., and 11.19 grams EC300 diamine obtained from Albemarle Corporation of Baton Rouge, L.A. (no heat). Optionally, add three drops if necessary of dibutyltin dilaurate (obtained from Aldrich Chemical Company of Milwaukee, Wiss.). Mix well quickly and degas the mixture for five minutes. Pour the mixture into a mold containing a pre-treated strengthening band mounted on a mandrel as described above, and cure at 80° C. for 18 hours.

EXAMPLE 4

Inner Sleeve Polyurethane Blanket Formulation with PIP Anti-stat

Heat VB635 diisocyanate-terminated prepolymer, obtained from Uniroyal Chemical Company of Middlebury, Conn., at 100° C. for two hours before use. Dry at 100° C. under vacuum T-1000 diol-terminated prepolymer obtained from Chemcentral Corporation of Buffalo, N.Y. for two hours before use. Weigh and mix according to the following order: 41.25 grams PIP anti-stat, 1330.44 grams T-1000, 1865.12 grams VB635, 63.185 grams TP-30 polyol from Perstorp Polyols Inc. of Toledo, Ohio, 17 drops of DABCO polymerization catalyst obtained from Aldrich Chemical Company of Milwaukee, Wiss. Mix extremely well and degas for 5–8 minutes. Pour the degassed mixture into a sleeve mold with the sleeve mounted on a mandrel as described above. Place the mold into a preheated 100° C. oven and cure at 100° C. for 16 hours.

Step (3)

Making a Protective Layer of an ISM:

A preferred material for a protective layer includes a ceramer. U.S. Pat. No. 5,968,656 teaches the art of ceramer overcoat composition and coating. The preferred coating method for the inventive ITM is ring coating. Alternatively, spray coating, dip coating and transfer coating are also valid methods. Before any coating procedure, the coating solution may be heated or diluted with co-solvent. A concentration to suitably control thickness, uniformity, drying and curing depends on the coating method chosen. Co-solvents include alcohol, acetate, ketones, and the like.

Preferred methods of making an inventive outer sleeve member (OSM) of a double-sleeved ITM, as specified with reference to the OSM depicted in FIG. 2, are similar to those for making an ISM as described above, with a difference in that a suitable stiffening layer is used instead of a strengthening band. Preferably, a stiffening layer includes a metal belt or a metal-plated belt, obtainable, e.g., from Stork Screens America, Inc., of Charlotte, N.C. In addition, a preferred release layer includes a ceramer, having similar composition to the protective layer of an ISM, and coated as described in step (3) above.

In addition to the methods described above in Steps (1), (2) and (3) for making an ISM, a method described in Example 5 below may be used to make an ISM having no added anti-stat for use with an electrically grounded photoconductive outer sleeve member.

EXAMPLE 5

Preparation of an Inner Sleeve Member for use with a Photoconductive Outer Sleeve Member.

A strengthening band, preferably in the form of a tubular metal belt including, for example nickel or copper-plated nickel, is mounted on a cylindrical aluminum mandril by means of compressed air assist, or by cooling the mandrel before sliding on the uncooled strengthening band and allowing the mandrel to return to ambient temperature. The mandrel plus its surrounding strengthening band is placed in the center of a cylindrical aluminum mold with a suitable gap between the outer core surface and the inner mold wall. The aluminum mandril and the cylindrical mold preferably have the same height. To a one-liter plastic beaker containing 50.79 g (50.79 meq) of a trimethylolpropane based polyfunctional polyol obtained as PPG2000 from Dow Chemical Co. of Midland, Mich., and two drops of a polydimethylsiloxane anti-foam agent obtained from Witco Corporation of Greenwich, Conn. as "SAG 47", there are added 238.09 g (164.76 meq) of a polyether based polyurethane prepolymer L42 obtained from Uniroyal Chemical Company of Middlebury, Conn. which analyzed as a toluene diisocyanate terminated polyether prepolymer. The reaction mixture is stirred at room temperature, under nitrogen, for two minutes, degassed under reduced pressure (0.1 mm Hg) and poured into the gap between the aluminum core and the cylinder mold. The polymer is cured at 80° C. for 18 hours and demolded with the mandrel. The mandrel plus polyurethane polymer around it is then ground to a suitable finished outer diameter, and a protective layer, preferably a ceramer, optionally coated on the polyurethane as described in step (3) above. The finished ISM is then removed from the mandrel, e.g., by using compressed air assist or by cooling the mandrel to allow the sleeve member to be readily removed from the mandrel.

A preferred method of making a photoconductive outer sleeve member (OSM) is described in Example 6 below, with reference to FIG. 4(*a*).

EXAMPLE 6

Preparation of a Photoconductive Outer Sleeve Member [FIG. 4(*a*)]

A stiffening layer in the form of a thin metal belt, e.g., a nickel belt obtained from Stork Screens America, Inc., of Charlotte, N.C. is mounted on a metal mandrel such as an aluminum mandrel, e.g., by means of compressed air assist, or by cooling the mandrel to permit the uncooled belt to be slid onto the mandrel. A useful thickness of the nickel belt is 0.005 inch thick. To form a barrier layer, the belt mounted on the mandrel is dip coated at 0.30 ips in a 3% wt/wt methanol solution of Amilan CM8000, a polyamide resin marketed by Toray Chemical Inc. of Japan; dried for 30 minutes at 90° C. To form a charge generating layer on the barrier layer, the belt is further coated at 0.30 ips with a 75:25 titanyl phthalocyanine/titanyl fluorophthalocyanine co-crystal dispersion disclosed by Molaire et al., in U.S. Pat. No. 5,614,342, followed by drying at 90° C. for 30 minutes. Lastly, to form a charge transport layer on the charge generating layer, the belt was further coated, at 0.30 ips, with a charge transport layer solution (14 wt % solids in dichloromethane as solvent) containing the following solids: 2 parts by weight of tri-tolylamine, 2 parts by weight of 1,1-bis (4-di-p-tolylaminophenyl) methane, 1 part by weight of poly[4,4'-(2-norbornylidene)bisphenol terephthalate-co-azelate-(60/40, and 5 parts by weight of Makrolon polycarbonate from the General Electric Company, Schenectady, N.Y., as described in U.S. Pat. No. 5,614,342. The fully coated belt with its outer charge transport layer coating is dried again at 100° C. for 30 minutes. Upon cooling, a completed photoconductive sleeve member in the form of the fully coated nickel belt is freed from the aluminum mandrel, e.g., by compressed air assist or by cooling the mandrel to allow the sleeve to be readily removed. Optionally, a thin hard outer layer may be formed on the charge transport layer.

EXAMPLE 7

Preparation of a Photoconductive Outer Sleeve Member [FIG. 4(*b*)]

A compliant photoconductive outer sleeve member (OSM) including a compliant layer beneath a photoconductive structure may be made as described below, with reference to OSM 40B in FIG. 4(*b*). A stiffening layer 41' in the form of a thin metal belt, e.g., obtained from Stork Screens America, Inc., of Charlotte, N.C. is mounted on a metal mandrel such as an aluminum mandrel, e.g., by means of compressed air assist, or by cooling the mandrel to permit the uncooled belt to be slid onto the mandrel. A useful thickness of the metal belt is 0.005 inch. Preferably, the belt is made of nickel or copper-plated nickel, and a thin compliant layer 45 of a polyurethane is formed on the belt in a mold, e.g., by the methods of steps (1) and (2), and Examples 1–4, inclusive. On top of the thin compliant layer 45 is formed a thin conductive electrode layer 46. Layer 46 may comprise any suitable conductive material, including conductive polymers which may, for example, comprise a metal, anti-stats or dispersed conductive particles, conductive organic materials, and so forth. Preferably, layer 46 includes electrolessly plated nickel. On top of layer 46 are successively formed, using for example the method described above in Example 6, a barrier layer 42', a CGL layer 43', and a CTL layer 44', and an optional thin hard outer layer. The finished photoconductive OSM may then be removed from the mandrel by compressed air assist or by cooling the mandrel to allow the sleeve to be slid off and removed.

In accordance with the above, and in the following numbered paragraphs below, it is apparent that the inventors have described:

¶1. A method of electrostatic transfer of electrostatographic toner particles including:

providing an electrostatographic double-sleeved roller (DSR) including a substantially cylindrical substantially rigid core member, a replaceable removable multilayer inner sleeve member (ISM) including at least one compliant layer such that the ISM surrounds and nonadhesively intimately contacts the core member, and a replaceable removable multilayer outer sleeve member (OSM) including at least one synthetic layer such that the OSM surrounds and nonadhesively intimately contacts the ISM;

creating a transferable toner image located on a portion of the outer surface of the OSM;

providing a pressure transfer nip between the OSM of the DSR and a transfer element;

providing an electric field for electrostatically transferring the transferable toner image;

rotating the DSR to bring the said transferable toner image located on a portion of the outer surface of the OSM into the transfer nip so as to electrostatically transfer the transferable toner image from the OSM to the transfer element.

¶2. The method of Paragraph 1 wherein the double-sleeved roller is a primary image-forming member.

¶3. The method of Paragraph 2 wherein the outer sleeve member of the primary image-forming member is photoconductive.

¶4. The method of Paragraph 1 wherein the double-sleeved roller is an intermediate transfer member.

¶5. The method of Paragraph 4 wherein the outer sleeve member of the intermediate transfer member is photoconductive.

¶6. The method of Paragraph 4 wherein the outer sleeve member of the intermediate transfer member includes at least one compliant layer.

¶7. The method of Paragraph 1 wherein the transfer element is a receiver sheet.

¶8. The method of Paragraph 1 wherein the transfer element is an intermediate transfer member.

¶9. The method of Paragraph 5 wherein the transferable toner image on the outer surface of the outer sleeve member includes a first single-color toner image superposed on a second single-color toner image.

¶10. The method of Paragraph 9 wherein prior to creation of the transferable toner image the second single-color toner image is formed on a portion of the outer surface of the outer sleeve member.

¶11. The method of Paragraph 9 wherein the transferable toner image is created by electrostatic transfer from a primary image-forming member of the first single-color toner image on top of the second single-color toner image so that the first and second single-color toner images are in registry on the outer sleeve member.

¶12. The method of Paragraph 11 wherein the primary image-forming member is a roller that includes a photoconductive sleeve member surrounding a substantially cylindrical substantially rigid core member.

¶13. The method of Paragraph 12 wherein the photoconductive sleeve member is an outer sleeve member of a double-sleeved roller.

¶14. The method of Paragraph 1 wherein the inner-sleeve member is a seamless endless belt.

¶15. The method of Paragraph 1 wherein the outer sleeve member is a seamless endless belt.

¶16. An electrostatographic imaging method including:

forming a toner image on a moving primary image-forming member (PIFM) including a first double-sleeved roller including a substantially rigid substantially cylindrical core member, a replaceable removable compliant inner sleeve member (ISM) in nonadhesive intimate contact with and surrounding the core member, and a replaceable removable photoconductive outer sleeve member (OSM) in nonadhesive intimate contact with and surrounding the ISM;

electrostatically transferring the toner image, from the PIFM to a counter-rotating intermediate transfer member (ITM) including a second double-sleeved roller, in a first transfer nip width produced by a pressure contact between the PIFM and the ITM, an electric field urging the toner image from the PIFM to the ITM, wherein the ITM includes a substantially rigid substantially cylindrical core member, a compliant ISM in nonadhesive intimate contact with and surrounding the core member, and a compliant resistive OSM in nonadhesive intimate contact with and surrounding the ISM;

providing a second transfer nip width in a transfer nip defined between an endless moving transport web and the ITM;

providing a transfer back-up roller behind the endless transport web and establishing an electric field between the ITM and the transfer back-up roller;

advancing a receiver member attached to said endless web into said nip, thereby establishing a transfer electric field for electrostatically transferring said toner image from the ITM to the receiver member.

¶17. An electrostatographic imaging method including:

forming a first single-color toner image on a moving primary image-forming member (PIFM) including a first double-sleeved roller including a substantially rigid substantially cylindrical core member, a replaceable removable compliant inner sleeve member (ISM) in nonadhesive intimate contact with and surrounding the core member, and a replaceable removable photoconductive outer sleeve member (OSM) in nonadhesive intimate contact with and surrounding the ISM;

forming a second single-color toner image on a counter-rotating photoconductive intermediate transfer member (ITM) including a second double-sleeved roller wherein the photoconductive ITM includes a substantially rigid substantially cylindrical core member, a replaceable removable compliant resistive ISM in nonadhesive intimate contact with and surrounding the core member, and a replaceable removable photoconductive OSM in nonadhesive intimate contact with and surrounding the ISM;

in a first transfer nip width produced by a pressure contact between the PIFM and the photoconductive ITM, electrostatically transferring the first single-color toner image from the PIFM in registry with and on top of the second single-color toner image on the ITM, an electric field urging the toner image from the PIFM to form a composite toner image on the ITM;

providing a second transfer nip width in a transfer nip defined between an endless moving transport web and the ITM;

providing a back-up roller behind the endless transport web and establishing an electric field between the ITM and the back-up roller;

advancing a receiver member attached to said endless web into said nip, thereby establishing a transfer electric field for electrostatically co-transferring said first and second toner images from the ITM to the receiver member.

¶18. An electrostatographic imaging method including:

forming a toner image on a moving primary image-forming member (PIFM) including a double-sleeved roller including a substantially rigid substantially cylindrical core member, a replaceable removable compliant inner sleeve member (ISM) in nonadhesive intimate contact with and surrounding the core member, and a replaceable removable photoconductive outer sleeve member in nonadhesive intimate contact with and surrounding the ISM;

providing a transfer nip width in a transfer nip defined between an endless moving transport web and the PIFM;

providing a transfer back-up roller behind the endless transport web and establishing an electric field between the PIFM and the transfer back-up roller;

advancing a receiver member attached to said endless web into said nip, thereby establishing a transfer electric field for electrostatically transferring said toner image from the PIFM to the receiver member, the electric field urging the toner image from the PIFM to the receiver member.

¶19. A reproduction method including:

providing a first and second double-sleeved toner image bearing members (TIBMs), each double-sleeved TIBM including a substantially rigid substantially cylindrical core member, a replaceable removable compliant inner sleeve member (ISM) in nonadhesive intimate contact with and surrounding the core member, and a replaceable removable outer sleeve member in nonadhesive intimate contact with and surrounding the ISM;

moving each of the first and second toner image bearing members, each of the TIBMs having a respective toner image formed thereon, through a respective transfer nip with a web that has or supports a toner image receiving surface;

moving the web through each nip with each TIBM, the web having or supporting on a first surface thereof the toner image receiving surface as the receiving surface is moved through the transfer nip with the first TIBM to the transfer nip with the second TIBM;

electrostatically transferring a toner image at each transfer nip to the receiving surface so that a toner image transferred by the second TIBM is deposited on the receiving surface so as to form a composite image with the toner image transferred to the receiving surface by the first TIBM.

¶20. The method of Paragraph 19 wherein the outer sleeve member is photoconductive.

¶21. The method of Paragraph 20 wherein the outer sleeve member includes a compliant layer.

¶22. A reproduction method including:

providing a rotating first and second double-sleeved primary image-forming members (DSPIFMs), each DSPIFM including a substantially rigid substantially cylindrical core member, a replaceable removable compliant inner sleeve member (ISM) in nonadhesive intimate contact with and surrounding the core member, and a replaceable removable outer sleeve member (OSM) in nonadhesive intimate contact with and surrounding the ISM, each OSM having a respective single-color toner image thereon;

providing a counter-rotating first and second double-sleeved intermediate transfer members (DSITMs), the first DSITM forming a first pressure nip with the first DSPIFM and the second DSITM forming a first pressure nip with the second DSPIFM, each DSITM including a substantially rigid substantially cylindrical core member, a replaceable removable compliant ISM in nonadhesive intimate contact with and surrounding the core member, and a replaceable removable OSM in nonadhesive intimate contact with and surrounding the ISM;

electrostatically transferring the respective single-color toner images from each respective DSPIFM to the respective DSITM in the respective first transfer nips;

moving each of the first and second toner-image-bearing DSITMs through a respective second transfer nip with a web that has or supports a toner image receiving surface;

moving the web through each second transfer nip with each DSITM, the web having or supporting the toner image receiving surface as the receiving surface is moved through the transfer nip with the first DSITM to the transfer nip with the second DSITM;

electrostatically transferring a single-color toner image at each second transfer nip to the receiving surface so that a single-color toner image transferred by the second DSITM is deposited on the receiving surface so as to form a composite image with the single-color toner image transferred to the receiving surface by the first DSITM.

¶23. The method according to Paragraph 22 wherein the outer sleeve member of each double-sleeved primary image-forming member is photoconductive.

¶24. A reproduction method including:

providing a rotating first and second double-sleeved primary image-forming members (DSPIFMs), each DSPIFM including a substantially rigid substantially cylindrical core member, a replaceable removable compliant inner sleeve member (ISM) in nonadhesive intimate contact with and surrounding the core member, and a replaceable removable outer sleeve member (OSM) in nonadhesive intimate contact with and surrounding the ISM, each OSM having a respective first single-color toner image thereon;

providing a counter-rotating first and second double-sleeved intermediate transfer members (DSITMs), each DSITM including a substantially rigid substantially cylindrical core member, a replaceable removable compliant ISM in nonadhesive intimate contact with and surrounding the core member, and a replaceable removable photoconductive OSM in nonadhesive intimate contact with and surrounding the ISM, the first DSITM forming a first pressure nip with the first DSPIFM and the second DSITM forming a first pressure nip with the second DSPIFM;

forming a second single-color toner images on the photoconductive OSMs of each of the first and second DSITMs by charging, image-wise exposing and toning at locations on the DSITMs prior to the first pressure nips;

in the respective first pressure nips electrostatically transferring from each respective DSPIFM the first single-color toner images to locations atop each second single-color toner images on the respective OSM of each DSITM, thereby forming a composite toner image on the surface of each DSITM;

moving each of the composite toner-image-carrying first and second DSITMs through a respective second transfer nip with a web that has or supports a toner image receiving surface;

moving the web through each second transfer nip with each DSITM, the web having or supporting the toner image receiving surface as the receiving surface is moved through the second transfer nip with the first DSITM to the second transfer nip with the second DSITM;

electrostatically transferring to the receiving surface a two-color composite toner image at each second transfer nip so that a two-color toner image transferred by the second DSITM is deposited on the receiving surface so as to form with the two-color toner image transferred to the receiving surface by the first DSITM a four-color composite image.

¶25. The method according to Paragraph 24 wherein the outer sleeve member of each double-sleeved primary image-forming member is photoconductive.

¶26. The method according to Paragraph 24 wherein the outer sleeve member of each double-sleeved intermediate transfer member is compliant.

¶27. The method according to Paragraph 24 wherein the four-color composite image includes cyan, magenta, yellow and black single-color toner images.

¶28. The method according to Paragraph 22 wherein the replaceable removable compliant inner sleeve member of each double-sleeved primary image-forming member and each double-sleeved intermediate transfer member includes:

a strengthening band (SB) having a Young's modulus less than 300 GPa and a thickness in a range 1–500 micrometers;

an inner sleeve compliant layer coated on the SB having a thickness in a range 5–20 mm, a Young's modulus less than 10 MPa, and a Poisson's ratio in a range 0.2–0.5;

a protective layer, coated on the inner sleeve compliant layer, having a thickness in a range 1–50 micrometers and a Young's modulus greater than 0.1 GPa.

¶29. The method according to Paragraph 22 wherein the replaceable removable outer sleeve member of each double-sleeved primary image-forming member includes:

a stiffening layer (SL) having a bulk electrical resistivity less than about $10^{10}$ ohm-cm, a thickness less than 500 micrometers, a Young's modulus greater than 0.1 GPa;

a photoconductive layer structure including one or more layers coated on the SL.

¶30. The method according to Paragraph 29 wherein the photoconductive layer structure includes:

a barrier layer coated on the stiffening layer;

a charge generating layer (CGL) coated on the barrier layer;

a charge transport layer coated on the CGL.

¶31. The method according to Paragraph 22 wherein the compliant replaceable removable outer sleeve member of each double-sleeved intermediate transfer member includes:

a stiffening layer (SL) having a bulk electrical resistivity less than about $10^{10}$ ohm-cm, a thickness less than 500 micrometers, a Young's modulus in a range 10–300 GPa;

an outer sleeve compliant layer coated on the SL having a thickness in a range 0.5–2 mm, a Young's modulus less than 10 MPa, a bulk electrical resistivity in a range $10^{7}$–$10^{11}$ ohm-cm, and a Poisson's ratio in a range 0.2–0.5;

a release layer coated on the outer sleeve compliant layer having a thickness in a range 1–50 micrometers, a Young's modulus greater than 100 MPa, and a bulk electrical resistivity in a range $10^{7}$–$10^{13}$ ohm-cm.

¶32. A double-sleeved roller (DSR) for use in an electrostatographic machine, the DSR including a substantially cylindrical substantially rigid core member, a replaceable removable multilayer inner sleeve member (ISM) in the shape of a seamless endless belt including at least one compliant layer such that the ISM surrounds and nonadhesively intimately contacts the core member, and a replaceable removable multilayer outer sleeve member (OSM) in the shape of a seamless endless belt including at least one synthetic layer such that the OSM surrounds and nonadhesively intimately contacts the ISM;

wherein the ISM is placeable on the core member by a sleeve placement method and the OSM is placeable on the ISM by a sleeve placement method, the OSM being removable from the ISM by a sleeve removal method and the ISM being removable from the core member by a sleeve removal method, any of the sleeve members retaining a form of an endless belt not only during operation of the DSR but also during placement of any sleeve member or during removal of any sleeve member.

¶33. A double-sleeved roller according to Paragraph 32 which includes an intermediate transfer member.

¶34. A double-sleeved roller according to Paragraph 32 which includes a primary image-forming member.

¶35. A double-sleeved roller according to Paragraph 34 wherein the outer sleeve member is photoconductive.

¶36. A double-sleeved roller according to Paragraph 32 wherein the core member remains fixed to a frame portion of the electrostatographic machine during placement or removal of an outer sleeve member or an inner sleeve member.

¶37. A double-sleeved roller according to Paragraph 33 wherein the intermediate transfer member includes a primary image-forming member.

¶38. A double-sleeved roller according to Paragraph 33 wherein the outer sleeve member of the intermediate transfer member is photoconductive.

¶39. An inner sleeve member including:

a strengthening band (SB) in the form of an endless seamless belt;

an inner sleeve compliant layer coated on the SB;

a protective layer coated in intimate contact with and surrounding the inner sleeve compliant layer.

¶40A. An inner sleeve member according to Paragraph 39 wherein the compliant layer has a thickness in a range 5–20 mm.

¶40B. An inner sleeve member according to Paragraph 40A wherein the compliant layer has a thickness in a range 2–10 mm.

¶41. An inner sleeve member according to Paragraph 39 wherein the compliant layer has a Young's modulus less than about 10 MPa.

¶42. An inner sleeve member according to Paragraph 39 wherein the compliant layer has a Young's modulus in a range 1–5 MPa.

¶43A. An inner sleeve member according to Paragraph 39 wherein the compliant layer has a Poisson's ratio in a range 0.2–0.5.

¶43B. An inner sleeve member according to Paragraph 39 wherein the compliant layer has a Poisson's ratio in a range 0.45–0.5.

¶44. An inner sleeve member according to Paragraph 39 wherein the protective layer has a thickness in a range 1–50 micrometers.

¶45. An inner sleeve member according to Paragraph 39 wherein the protective layer has a thickness in a range 1–50 micrometers.

¶46. An inner sleeve member according to Paragraph 39 wherein the protective layer has a Young's modulus greater than 100 MPa.

¶47. An inner sleeve member according to Paragraph 39 wherein the protective layer has a Young's modulus in a range 0.5–20 GPa.

¶48. An inner sleeve member according to Paragraph 39 wherein the strengthening band has a Young's modulus less than 300 GPa.

¶49. An inner sleeve member according to Paragraph 39 wherein the strengthening band has a thickness in a range 1–500 micrometers.

¶50. An inner sleeve member according to Paragraph 39 wherein the strengthening band has a thickness in a range 5–150 micrometers.

¶51. A photoconductive outer sleeve member including:

a stiffening layer (SL) in the form of an endless seamless belt;

a photoconductive layer structure including one or more layers coated on the SL.

¶52. A photoconductive outer sleeve member according to Paragraph 51 wherein the stiffening layer is conductive and is connected to an electrical source of voltage or current.

¶53. A photoconductive outer sleeve member according to Paragraph 51 wherein the stiffening layer is conductive and is connected to ground potential.

¶54. A photoconductive outer sleeve member according to Paragraph 51 wherein the stiffening layer is made of nickel.

¶55. A photoconductive outer sleeve member according to Paragraph 51 wherein said photoconductive layer structure includes:

a barrier layer coated on the stiffening layer;

a charge generating layer (CGL) coated on the barrier layer;

a charge transport layer coated on the CGL.

¶56. A photoconductive outer sleeve member according to Paragraph 55 wherein the charge-transport layer is overcoated with a hard layer.

¶57. A compliant outer sleeve member including:

a stiffening layer (SL) in the form of an endless seamless belt;

an outer sleeve compliant layer coated on the SL;

a release layer coated on the thin compliant layer.

¶58. A compliant outer sleeve member according to Paragraph 57 wherein the stiffening layer is conductive and is connected to an electrical source of voltage or current.

¶59. A compliant outer sleeve member according to Paragraph 57 wherein the stiffening layer is conductive and is connected to ground potential.

¶60. A compliant outer sleeve member according to Paragraph 57 wherein the stiffening layer is made of nickel.

¶61. A compliant photoconductive outer sleeve member including:

a stiffening layer (SL) in the form of an endless seamless belt;

a compliant layer coated on the SL;

a thin conductive layer coated on the thin compliant layer;

a barrier layer coated on the thin conductive layer;

a charge generating layer (CGL) coated on the barrier layer;

a charge transport layer (CTL) coated on the CGL.

¶62. A compliant photoconductive outer sleeve member according to Paragraph 61 wherein the charge transport layer is optionally overcoated with a hard layer.

¶63. A compliant photoconductive outer sleeve member according to Paragraph 61 wherein the thin conductive layer is connected to an electrical source of voltage or current.

¶64. A compliant photoconductive outer sleeve member according to Paragraph 61 wherein the thin conductive layer is made of nickel.

¶65. A compliant photoconductive outer sleeve member according to Paragraph 61 wherein the stiffening layer is made of nickel.

¶66. An outer sleeve member according to Paragraphs 51 and 57 wherein the stiffening layer has a bulk electrical resistivity less than about $10^{10}$ ohm-cm.

¶67. An outer sleeve member according to Paragraphs 51, 57 and 61 wherein the stiffening layer has a thickness less than about 500 micrometers.

¶68. An outer sleeve member according to Paragraphs 51, 57 and 61 wherein the stiffening layer has a thickness in a range 10–200 micrometers.

¶69. An outer sleeve member according to Paragraphs 51, 57 and 61 wherein the stiffening layer has a Young's modulus greater than about 0.1 GPa.

¶70A. An outer sleeve member according to Paragraphs 51 and 61 wherein the stiffening layer has a Young's modulus in a range 50–300 GPa.

¶70B. An outer sleeve member according to Paragraph 57 wherein the stiffening layer has a Young's modulus in a range 100–300 GPa.

¶71. An outer sleeve member according to Paragraphs 57 and 61 wherein the compliant layer has a thickness in a range 0.5–2 mm.

¶72. An outer sleeve member according to Paragraphs 57 and 61 wherein the compliant layer has a bulk electrical resistivity in a range $10^{7}$–$10^{11}$ ohm-cm.

¶73. An outer sleeve member according to Paragraphs 57 and 61 wherein the compliant layer has a bulk electrical resistivity of about $10^{9}$ ohm-cm.

¶74. An outer sleeve member according to Paragraphs 57 and 61 wherein the compliant layer has a Young's modulus less than about 10 MPa.

¶75. An outer sleeve member according to Paragraphs 57 and 61 wherein the compliant layer has a Young's modulus in a range 1–5 MPa.

¶76A. An outer sleeve member according to Paragraphs 57 and 61 wherein the compliant layer has a Poisson's ratio in a range 0.2–0.5.

¶76B. An outer sleeve member according to Paragraph 76A wherein the compliant layer has a Poisson's ratio in a range 0.45–0.5.

¶77. An outer sleeve member according to Paragraph 57 wherein the release layer has a thickness in a range 1–50 micrometers.

¶78. An outer sleeve member according to Paragraph 57 wherein the release layer has a thickness in a range 1–50 micrometers.

¶79A. An outer sleeve member according to Paragraph 57 wherein the release layer has a Young's modulus greater than 100 MPa.

¶79B. An outer sleeve member according to Paragraph 57 wherein the release layer has a Young's modulus in a range 0.5–20 GPa.

¶80. An outer sleeve member according to Paragraph 57 wherein the release layer has a bulk electrical-resistivity in a range $10^7$–$10^{13}$ ohm-cm.

¶81. An outer sleeve member according to Paragraph 57 wherein the release layer has a bulk electrical resistivity of about $10^{10}$ ohm-cm.

¶82. An outer sleeve member according to Paragraphs 55 and 61 wherein the barrier layer includes a nylon material having a thickness in a range 0.5–1.0 micrometer.

¶83. An outer sleeve member according to Paragraphs 55 and 61 wherein the charge generating layer has a thickness in a range 0.25–1.0 micrometer.

¶84. An outer sleeve member according to Paragraphs 55 and 61 wherein the charge transport layer has a thickness in a range 12–35 micrometers.

¶85. The methods according to Paragraphs 1, 12, 16, 17, 18, 19, 22, and 24, wherein the core member has a runout of less than 80 micrometers.

¶86. The methods according to Paragraphs 1, 12, 16, 17, 18, 19, 22, and 24, wherein the core member has a runout of less than 20 micrometers.

¶87. A double-sleeved roller according to Paragraph 32 wherein the core member has a runout of less than 80 micrometers.

¶88. A double-sleeved roller according to Paragraph 32 wherein the core member has a runout of less than 20 micrometers.

¶89. A double-sleeved roller according to Paragraph 32 wherein the sleeve removal method includes:

providing a source of a pressurized fluid to the underside of a sleeve member;

turning on the source of the pressurized fluid to elastically expand the sleeve member so as to allow the sleeve member to be moved along the surface of another member that it surrounds;

sliding the sleeve member and removing it from the said another member while continuing to keep open the source of pressurized fluid;

shutting off the source of the pressurized fluid;

wherein the said another member is a core member or an inner sleeve member mounted on a core member.

¶90. A double-sleeved roller according to Paragraph 32 wherein the sleeve placement method includes:

providing a source of a pressurized fluid to the underside of a sleeve member;

turning on the source of the pressurized fluid to elastically expand the sleeve member so as to allow the sleeve member to be moved along the surface of another member in order to surround the another member;

sliding the sleeve member until it reaches a predetermined position surrounding the said another member while continuing to keep open the source of pressurized fluid;

shutting off the source of the pressurized fluid, thereby allowing the sleeve member to relax and grip the said another member under tension;

wherein the said another member is a core member or an inner sleeve member mounted on a core member.

¶91. A double-sleeved roller according to Paragraphs 89 and 90 wherein the pressurized fluid includes compressed air.

¶92. A double-sleeved roller (DSR) according to Paragraph 32 wherein the outer sleeve member is replaced or removed from a first end of said DSR and the inner sleeve member is replaced or removed from a second end of said DSR, wherein the second end of the DSR remains fixed to a frame portion of the machine when the outer sleeve member is replaced or removed and the first end of the DSR remains fixed to another frame portion of the machine when the inner sleeve member is replaced or removed.

¶93. A DSR (double-sleeved roller) according to Paragraph 32 wherein the outer sleeve member and the inner sleeve member are replaced or removed from a same one end of said DSR, wherein the opposite end of the DSR remains fixed to a same frame portion of the machine when the outer sleeve member is replaced or removed and when the inner sleeve member is replaced or removed.

The invention has been described in detail with reference to presently preferred embodiments, but it will be understood that variations and modifications can be effected within the spirit and scope of the invention.

What is claimed is:

1. A double-sleeved roller for use in an electrostatographic machine, comprising:

a cylindrical rigid core member;

a removable inner sleeve member (ISM) including a compliant layer such that the ISM surrounds and intimately contacts said rigid core member;

a removable outer sleeve member (OSM) including a photoconductive outer sleeve compliant layer such that the OSM surrounds and intimately contacts said ISM.

2. The double-sleeved roller according to claim 1, when used as an intermediate transfer member roller or primary imaging forming member roller, includes as said inner sleeve member a strengthening band in the shape of a tubular endless belt; said inner sleeve member compliant layer being formed on the strengthening band; and a protective layer coated on the inner sleeve compliant layer.

3. The double-sleeved roller according to claim 2 wherein said strengthening band has a Young's modulus less than 300 GPa and a thickness in a range of approximately 1–500 micrometers; said inner sleeve member compliant layer has a thickness in a range of approximately 5–20 mm, a Young's modulus less than about 10 MPa, and a Poisson's ratio in a range of approximately 0.2–0.5; and said protective layer has a thickness in a range of approximately 1–50 micrometers, and a Young's modulus greater than 100 MPa.

4. A double-sleeved roller according to claim 2 wherein said strengthening band has a thickness in a range of approximately 5–150 micrometers; said inner sleeve member compliant layer has a thickness in a range of approximately 2–10 mm, a Young's modulus in a range of approximately 1–5 MPa, and a Poisson's ratio in a range of approximately 0.45–0.5; and said protective layer has a thickness in a range of approximately 1–50 micrometers, and a Young's modulus in a range of approximately 0.5–20 GPa.

5. The double-sleeved roller according to claim 1, when used as an intermediate transfer member roller, includes as said outer sleeve member a stiffening layer in the shape of a tubular endless belt; said outer sleeve member having said compliant layer formed on said stiffening layer; and a release layer coated on said outer sleeve member compliant layer.

6. The double-sleeved roller according to claim 5 wherein said stiffening layer has a thickness less than about 500 micrometers, a Young's modulus preferably greater than about 0.1 GPa, and a bulk electrical resistivity of less than about $10^{10}$ ohm-cm; said outer sleeve member compliant layer has a Young's modulus less than about 10 MPa, a thickness in range of approximately 0.5–2 mm, a Poisson's ratio in a range of approximately 0.2–0.5, and a bulk electrical resistivity preferably in a range $10^{7}$–$10^{11}$ ohm-cm; and said release layer has a Young's modulus greater than 100 MPa, a thickness in a range of approximately 1–50 micrometers, and a bulk electrical resistivity preferably in a range $10^{7}$–$10^{13}$ ohm-cm.

7. The double-sleeved roller according to claim 5 wherein said stiffening layer has a thickness in a range of approximately 10–200 micrometers and a Young's modulus in a range of approximately 50–300 GPa; said outer sleeve member compliant layer has a Young's modulus in a range of approximately 1–5 MPa, a Poisson's ratio in a range of approximately 0.45–0.5, and a bulk electrical resistivity of about $10^{9}$ ohm-cm; and said release layer has a Young's modulus in a range of approximately 0.5–20 GPa, a thickness in a range of approximately 1–50 micrometers, and a bulk electrical resistivity of about $10^{10}$ ohm-cm.

8. The double-sleeved roller according to claim 1, when used as a primary image forming member roller, includes as said outer sleeve member a stiffening layer in the shape of a tubular endless belt with the compliant layer on said stiffing layer; a barrier layer coated on said compliant layer; a charge generating layer coated on said barrier layer; and a charge transport layer coated on said charge generating layer.

9. The double-sleeved roller according to claim 8 wherein said stiffening layer has a thickness less than 500 micrometers and a Young's modulus greater than 0.1 GPa.

10. The double-sleeved roller according to claim 8 wherein said stiffening layer has a thickness in a range of approximately 10–200 micrometers and a Young's modulus in a range of approximately 50–300 GPa.

11. A double-sleeved roller according to claim 8 wherein said stiffening layer is nickel; said barrier layer has a thickness in a range of approximately 0.5–1.0 micrometers; said charge generating layer has a thickness in a range of approximately 0.5–1.0 micrometer; and said charge transport layer has thickness in a range of approximately 12–35 micrometers.

12. The double-sleeved roller according to claim 8 wherein said stiffening layer is an electroformed seamless nickel belt about 127 micrometers thick; said barrier layer is a polyamide resin; said charge generating layer is a co-crystal dispersion having a thickness of about 0.5 micrometer; and said charge transport layer has a thickness of about 25 micrometers.

13. The double-sleeved roller according to claim 8 further including a compliant layer formed on said stiffening layer.

14. The double-sleeved roller according to claim 13 wherein said stiffening layer has a thickness less than 500 micrometers and a Young's modulus greater than 0.1 GPa; and said compliant layer has a Young's modulus less than about 10 MPa, a thickness in range of approximately 0.5–2 mm, and a Poisson's ratio in a range of approximately 0.2–0.5.

15. The double-sleeved roller according to claim 13 wherein said stiffening layer has a thickness in a range of approximately 10–200 micrometers and a Young's modulus in a range of approximately 50–300 GPa; and said compliant layer has a Young's modulus in a range of approximately 1–5 MPa and a Poisson's ratio in a range of approximately 0.45–0.5.

16. The double-sleeved roller according to claim 13 wherein said stiffening layer is nickel; said electrode layer is a thin layer of nickel; said barrier layer is a polyamide resin having a thickness in a range of approximately 0.5–1.0 micrometers; said charge generating layer is a 75:25 titanyl phthalocyanine/titanyl fluorophthalocyanine co-crystal dispersion having a thickness in a range of approximately 0.5–1.0 micrometer; and said charge transport layer comprises a polyurethane and has thickness in a range of approximately 12–35 micrometers.

17. The double-sleeved roller according to claim 16 wherein said stiffening layer is an electroformed seamless nickel belt about 127 micrometers thick; said charge generating layer has a thickness of about 0.5 micrometer; and said charge transport layer has a thickness of about 25 micrometers.

18. A double-sleeved roller according to claim 1 further including an indicia located on said inner sleeve member; and an indicia located on said outer sleeve member, wherein each indicia on said inner sleeve member are provided to indicate an operating parameter relative to said inner sleeve member that may be detected by an indicia detector and such indicia on said outer sleeve member are provided to indicate an operating parameter relative to said outer sleeve member that may be detected by an indicia detector.

19. An electrostatographic imaging method comprising the steps of:

forming a toner image on a moving primary image-forming member (PIFM) which is a first double-sleeved roller including a rigid cylindrical core member, a replaceable removable compliant inner sleeve member (ISM) in nonadhesive intimate contact with and surrounding the core member, and a replaceable removable photoconductive outer sleeve member (OSM) in nonadhesive intimate contact with and surrounding the ISM;

electrostatically transferring the toner image, from the PIFM to a counter-rotating intermediate transfer member (ITM) which is a second double-sleeved roller, in a first transfer nip width produced by a pressure contact between the PIFM and the ITM, an electric field urging the toner image from the PIFM to the ITM, wherein the ITM includes a rigid cylindrical core member, a compliant ISM in nonadhesive intimate contact with and surrounding the core member, and a compliant resistive OSM in nonadhesive intimate contact with and surrounding the ISM;

providing a second transfer nip width in a transfer nip produced by a pressure applied between the ITM and a transfer roller;

establishing an electric field between the ITM and the transfer roller; and advancing a receiver member into said second transfer nip to electrostatically transfer said toner image from the ITM to the receiver member.

20. A reproduction method comprising the steps of:

providing at least a first and second double-sleeved toner image bearing members (TIEBMs), wherein the first double-sleeved TIEBM is made of a first rigid cylindrical core member with a first replaceable removable compliant inner sleeve member (ISM) in nonadhesive intimate contact with and surrounding the first core member and a first replaceable removable outer sleeve member in nonadhesive intimate contact with and surrounding the first ISM, and, wherein the second double-sleeved TIBM is made of a second rigid cylindrical core member with a second replaceable removable compliant inner sleeve member (ISM) in nonadhesive intimate contact with and surrounding the second core member and a second replaceable removable outer sleeve member in nonadhesive intimate contact with and surrounding the second ISM;

moving each of the at least first and second double-sleeved toner image bearing members, each of the TIBMs having a respective toner image formed thereon, through a respective transfer nip with a web that has a toner image receiving surface;

moving the web through each nip with each double-sleeved TIBM, the web having on a surface thereof the toner image receiving surface as the receiving surface is moved through the transfer nip with the first TIBM to the transfer nip with the second TIBM; and electrostatically transferring a toner image at each transfer nip to the receiving surface so that a toner image transferred by the second TIBM is deposited on the receiving surface so as to form a composite image with the toner image transferred to the receiving surface by the first TIBM.

21. A reproduction method comprising the steps of:

providing at least a rotating first and second double-sleeved primary image-forming members (DSPIFMs), wherein the first DSPIFM is made of a first rigid cylindrical core member with a first replaceable removable compliant inner sleeve member (ISM) in nonadhesive intimate contact with and surrounding the first core member and a first replaceable removable outer sleeve member (OSM) in nonadhesive intimate contact with and surrounding the first ISM, and, wherein further the second DSPIFM is made of a second rigid cylindrical core member with a second replaceable removable compliant inner sleeve member (ISM) in nonadhesive intimate contact with and surrounding the second core member and a second replaceable removable outer sleeve member (OSM) in nonadhesive intimate contact with and surrounding the second ISM, each of the first and second OSMs having a respective single-color toner image thereon;

providing at least a counter-rotating first and second double-sleeved intermediate transfer members (DSITMs), the first DSITM forming a first pressure nip with the first DSPIFM and the second DSITM forming a first pressure nip with the second DSPIFM, wherein each first DSITM is made of a first rigid cylindrical core member with a first replaceable removable compliant ISM in nonadhesive intimate contact with and surrounding the first core member and a first replaceable removable OSM in nonadhesive intimate contact with and surrounding the first ISM, and wherein further each second DSITM is made of a second rigid cylindrical core member with a second replaceable removable compliant ISM in nonadhesive intimate contact with and surrounding the second core member and a second replaceable removable OSM in nonadhesive intimate contact with and surrounding the second ISM;

electrostatically transferring the respective single-color toner images from each respective DSPIFM to the respective DSITM in the respective first transfer nips;

moving each of the at least first and second toner-image-bearing DSITMs through a respective second transfer nip with a web that has a toner image receiving surface;

moving the web through each second transfer nip with each DSITM, the web having the toner image receiving surface as the receiving surface is moved through the transfer nip with the first DSITM to the transfer nip with the second DSITM; and electrostatically transferring a respective single-color toner image at each second transfer nip to the receiving surface so that a single-color toner image transferred by the second DSITM is deposited on the receiving surface so as to form a composite image with the single-color toner image transferred to the receiving surface by the first DSITM.

* * * * *